United States Patent [19]

Mozer

[11] Patent Number: 4,458,110

[45] Date of Patent: Jul. 3, 1984

[54] STORAGE ELEMENT FOR SPEECH SYNTHESIZER

[76] Inventor: Forrest S. Mozer, 38 Somerset Pl., Berkeley, Calif. 94707

[21] Appl. No.: 81,248

[22] Filed: Oct. 2, 1979

Related U.S. Application Data

[60] Division of Ser. No. 761,210, Jan. 21, 1977, Pat. No. 4,214,125, which is a continuation of Ser. No. 632,140, Jan. 14, 1975, abandoned, which is a continuation-in-part of Ser. No. 525,388, Nov. 20, 1974, abandoned, which is a continuation-in-part of Ser. No. 432,859, Jan. 14, 1974, abandoned.

[51] Int. Cl.[3] ..... G10L 1/00

[52] U.S. Cl. ..... 381/32; 381/51; 367/198

[58] Field of Search ..... 179/1 SM, 1 SG, 15.55 R, 179/15.55 T; 84/1.01, 1.03; 340/347 DD

[56] References Cited

U.S. PATENT DOCUMENTS

| | | | |
|---|---|---|---|
| 3,501,750 | 3/1970 | Anderson | 340/347 DD |
| 3,641,496 | 2/1972 | Slavin | 179/1 SM |
| 3,763,364 | 10/1973 | Deutsch et al. | 84/1.03 |
| 3,784,754 | 1/1974 | Hagiwara et al. | 179/1 SM |
| 3,803,358 | 4/1974 | Schirf et al. | 179/1 SM |
| 3,809,786 | 5/1974 | Deutsch | 84/1.01 |

*Primary Examiner*—Emanuel S. Kemeny
*Attorney, Agent, or Firm*—Townsend and Townsend

[57] ABSTRACT

A storage device for use with a synthesizer of original information bearing time domain signals from compressed information time domain signals produced by predetermined different signal compression techniques. The storage device contains compressed information time domain signals and instruction signals specifying the particular compression technique applied to the original information bearing time domain signals to produce corresponding portions of the compressed information time domain signals. The compressed information time domain signals comprise a plurality of samples resulting from the predetermined signal compression techniques, the number of the different signal compression techniques applied to the original signals being greater than two and the ratio of the plurality of the samples to the minimum number of samples required to uniquely and intelligibly identify the original information bearing signals being no greater than about 0.2.

3 Claims, 3 Drawing Figures

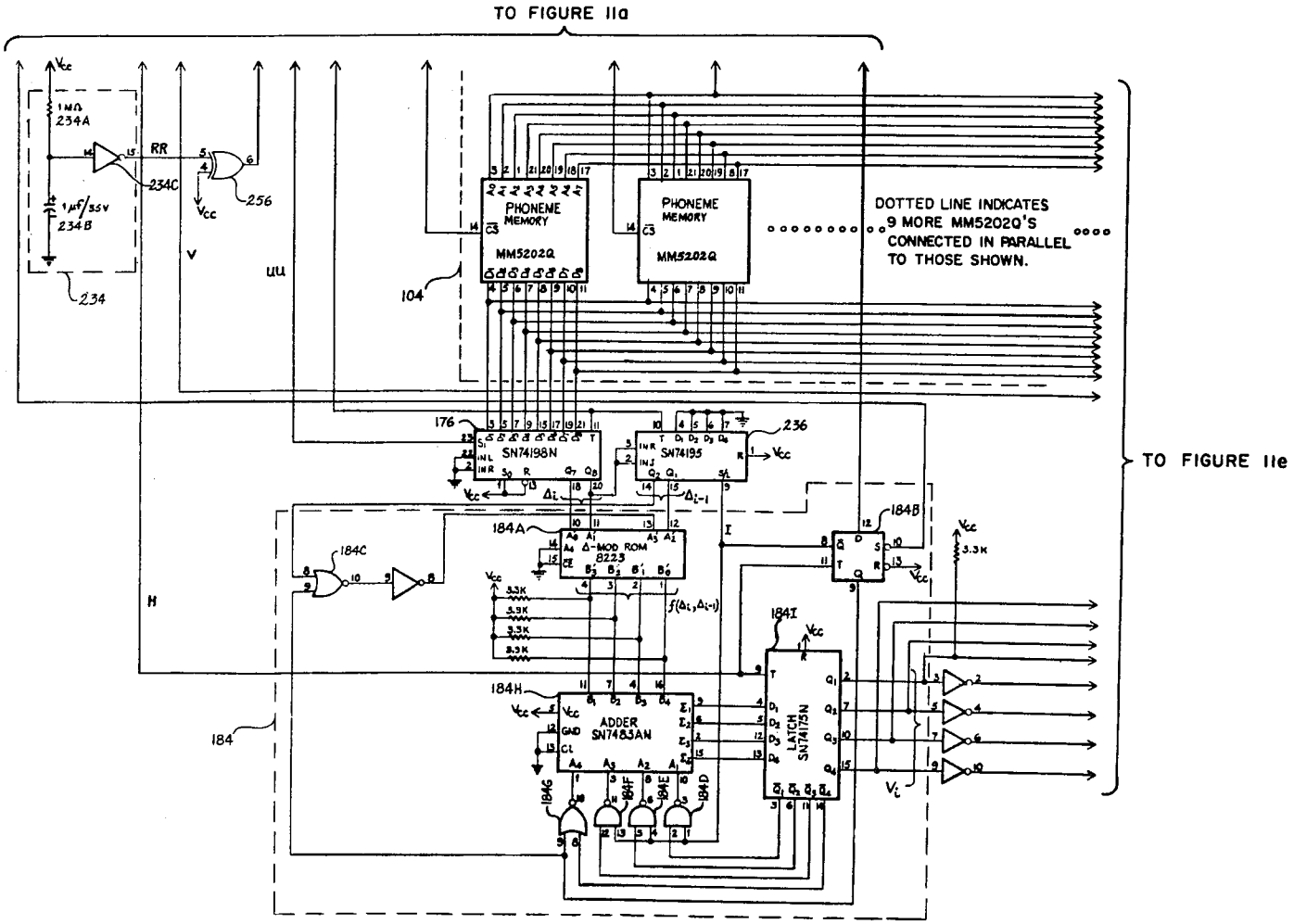
FIG. IId

STORAGE ELEMENT FOR SPEECH SYNTHESIZER

CROSS-REFERENCES TO RELATED APPLICATIONS

This application is a divisional of co-pending application Ser. No. 761,210, filed Jan. 21, 1977 entitled "METHOD AND APPARATUS FOR SPEECH SYNTHESIZING," now U.S. Pat. No. 4,214,125 issued July 22, 1980 which is a continuation of application Ser. No. 632,140, filed Nov. 14, 1975 entitled "METHOD AND APPARATUS FOR SPEECH SYNTHESIZING," now abandoned, which is a continuation-in-part of application Ser. No. 525,388, filed Nov. 20, 1974, entitled "METHOD AND APPARATUS FOR SPEECH SYNTHESIZING," now abandoned, which, in turn, is a continutation-in-part of application Ser. No. 432,859, filed Jan. 14, 1974, entitled "METHOD FOR SYNTHESIZING SPEECH AND OTHER COMPLEX WAVEFORMS," which was abandoned in favor of application Ser. No. 525,388.

INCORPORATION BY REFERENCE

The entire disclosure of commonly owned, allowed co-pending application Ser. No. 761,210, filed Jan. 21, 1977, entitled "METHOD AND APPARATUS FOR SPEECH SYNTHESIZING" now U.S. Pat. No. 4,214,125 issued July 22, 1980 is hereby incorporated by reference.

This disclosure has tables and figures not numbered sequentially because they are excerpted from the full sequence in the parent disclosure, now U.S. Pat. No. 4,214,125, incorporated by reference.

FIELD OF THE INVENTION

The present invention relates to speech synthesis and more particularly to a method for analyzing and synthesizing speech and other complex waveforms using basically digital techniques.

SUMMARY OF THE INVENTION

The invention comprises a storage device for use with an apparatus for synthesizing speech or other complex waveforms previously digitized and compressed by one or more predetermined techniques using a human operator and a digital computer which discard portions of the time quantized signals while generating instruction signals as to which of the techniques have been employed. The compressed, time quantized signals and the compression instruction signals are stored in the storage device, which preferably comprises a digital memory unit of a solid state speech synthesizer. The compressed information time domain signals comprise a plurality of samples resulting from the predetermined signal compression techniques, the number of the different signal compression techniques applied to the original signals being greater than two, and the ratio of the plurality of samples to the minimum number of samples required to uniquely and intelligibly identify the original information bearing signals being no greater than about 0.2. Both the stored, compressed, time quantized signals and the compression instruction signals in the speech synthesizer circuit are selectively retrieved to reconstruct selected portions of the original complex waveform.

In the preferred embodiments the compression techniques used by a computer operator in generating the compressed speech information and instruction signals to be loaded into the memories of the speech synthesizer circuit from the computer memory take several forms which are discussed in greater detail in the referenced parent application. Briefly summarized, these compression techniques are as follows. The techniques termed "X period zeroing" comprises the steps of deleting preselected relatively low power fractional portions of the input information signals and generating instruction signals specifying those portions of the signals so deleted which are to be later replaced during synthesis by a constant amplitude signal of predetermined value, the term "X" corresponding to a fractional portion of the signal thus compressed. The term "phase adjusting"—also designated Mozer phase adjusting—comprises the steps of Fourier transforming a periodic time signal to derive frequency components whose phases are adjusted such that the resulting inverse Fourier transform is a time-symmetric pitch period waveform whereby one-half of the original pitch period is made redundant. The technique termed "phoneme blending" comprises the step of storing portions of input signals corresponding to selected phonemes and phoneme groups according to their ability to blend naturally with any other phoneme. The technique termed "pitch period repetition" comprises the steps of selecting signals representative of certain phonemes and phoneme groups from information input signals and storing only portions of these selected signals corresponding to every nth pitch period of the wave form while storing instruction signals specifying which phonemes and phoneme groups have been so selected and the value of n. The technique termed "multiple use of syllables" comprises the step of separating signals representative of spoken words into two or more parts, with such parts of later words that are identical to parts of earlier words being deleted from storage in a memory while instruction signals specifying which parts are deleted are also stored. The technique termed "floating zero, two-bit delta modulation" comprises the steps of delta modulating digital signals corresponding to information input signals prior to storage in a first memory by setting the value of the ith digitization of the sampled signal equal to the value of the $(i-1)$th digitization of the sampled signals plus $f(\Delta_{i-1}, \Delta_i)$ where $f(\Delta_{i-1}, \Delta_i)$ is an arbitrary function having the property in a specific embodiment that changes of wave form of less than two levels from one digitization to the next are reproduced exactly while greater changes in either direction are accommodated by slewing in either direction by three levels per digitization. Preferably, the phase adjusting technique includes the step of selecting the representative symmetric wave form which has a minimum amount of power in one-half of the period being analyzed and which possesses the property that the difference between amplitudes of successive digitizations during the other half period of the selected wave form are consistent with possible values obtainable from the delta modulation step. The techniques, in addition to taking the time derivative and time quantizing the signal information, involve discarding portions of the complex waveform within each period of the waveform, e.g. a portion of the pitch period where the waveform represents speech and multiple repetitions of selected waveform periods while discarding other periods. In the case of speech waveforms, the presence of certain phonemes are detected and/or generated and are multiply repeated as are syllables formed of certain phonemes. Furthermore, certain of the speech information is selectively delta modulated according to an arbitrary function, to be described, which allows a compression factor of approximately two while preserving a large amount of speech intelligibility.

In contrast to the goals of earlier speech synthesis research to reproduce an unlimited vocabulary, the present invention has resulted from the desire to develop a speech synthesizer having a limited vocabulary on the order of one hundred words but with a physical size of less than about 0.25 inches square. This extremely small physical size is achieved by utilizing only digital techniques in the synthesis and by building the resulting circuit on a single LSI (large scale integration) electronic chip of a type that is well known in the fabrication of electronic calculators or digital watches. These goals have precluded the use of vocoder technology and resulted in the development of a synthesizer from wholly new concepts. By uniquely combining the above mentioned, newly developed compression techniques with known compression techniques, the present invention is able to store information sufficient for such multi-word vocabulary onto a single LSI chip without significantly compromising the intelligibility of the original information.

The uses for compact synthesizers produced in accordance with the invention are legion. For instance, such a device can serve in an electronic calculator as a means for providing audible results to the operator without requiring that he shift his eyes from his work. Or it can be used to provide numbers in other situations where it is difficult to read a meter. For example, upon demand it could tell a driver the speed of his car, it could tell an electronic technicision the voltage at some point in his circuit, it could tell a precision machine operator the information he needs to continue his work, etc. It can also be used in place of a visual readout for an electronic timepiece. Or it could be used to give verbal messages under certain conditions. For example, it could tell an automobile driver that his emergency brake is on, or that his seatbelt should be fastened, etc. Or it could be used for communication between a computer and man, or as an interface between the operator and any mechanism, such as a pushbutton telephone, elevator, dishwasher, etc. Or it could be used in novelty devices or in toys such as talking dolls.

The above, of course, are just a few examples of the demand for compact units. The prior art has not been able to fill this demand, because presently available, unlimited vocabulary speech synthesizers are too large, complex and costly. The invention, hereinafter to be described in greater detail, provides an apparatus for relatively simple and inexpensive speech synthesis which, in the preferred embodiment, uses basically digital techniques.

It is therefore an object of the present invention to provide a compact speech synthesizer.

It is another object of the present invention to provide a storage device for a speech synthesizer using only one or a few LSI or equivalent electronic chips each having linear dimensions of approximately $\frac{1}{4}$ inch on a side.

It is still another object of the invention to provide a storage device for a speech synthesizer using basically digital rather than analog techniques.

It is a further object of the present invention to provide a storage device for a speech synthesizer in which the information content of the phoneme waveform is compressed by storing only selected portions of that waveform.

Yet a further object of the present invention is to provide a storage device for a speech synthesizer capable of being manufactured at low cost.

The foregoing and other objectives, features and advantages of the invention will be more readily understood upon consideration of the following detailed description of certain preferred embodiments of the invention, taken in conjunction with the accompanying drawings.

DETAILED DESCRIPTION OF CERTAIN PREFERRED EMBODIMENTS

Straight-forward storage of digitized speech waveforms in an electronic memory cannot be used to produce a vocabulary of 128 words on a single LSI chip because the information content in 128 words is far too great, as the following example illustrates. In order to record frequencies as high as 7500 Hertz, the waveform digitization should occur 15,000 times per second. Each digitization should contain at least six bits of amplitude information for reasonable intelligibility. Thus, a typical word of $\frac{1}{2}$ second duration produces $15{,}000\times\frac{1}{2}\times 6=45{,}000$ bits of binary information that must be stored in the electronic memory. Since the size of an economical LSI read-only memory (ROM) is less than 45,000 bits, the information content of ordinary speech must be compressed by a factor in excess of 100 in order to store a 128-vocabulary on a single LSI chip.

In the preferred embodiment of the present invention, a compression factor of about 450 has been realized to allow storage of 128 words in a 16,320 bit memory. This compression factor has been achieved through studies of information compression on a computer, and a speech synthesizer with the one-hundred and twenty-eight word vocabulary given in Table 2 below has been constructed from integrated, logic circuits and memories. In this application this vocabulary should be considered merely a prototype of more detailed speech synthesizers constructed according to the invention.

TABLE 2

| Vocabulary of the Speech Synthesizer | | |
|---|---|---|
| The numbers "0"–"99", inclusive; | | |
| "plus ", | "minus", | "times", |
| "over", | "equals", | "point", |
| "overflow", | "volts", | "ohms", |
| "amps", | "dc", | "ac", |
| "and", | "seconds", | "down", |
| "up", | "left", | "pounds", |
| "ounces", | "dollars", | "cents", |
| "centimeters", | "meters", | "miles", |
| "miles per hour", | a short period of silence, and | a long period of silence |

Figure 1:
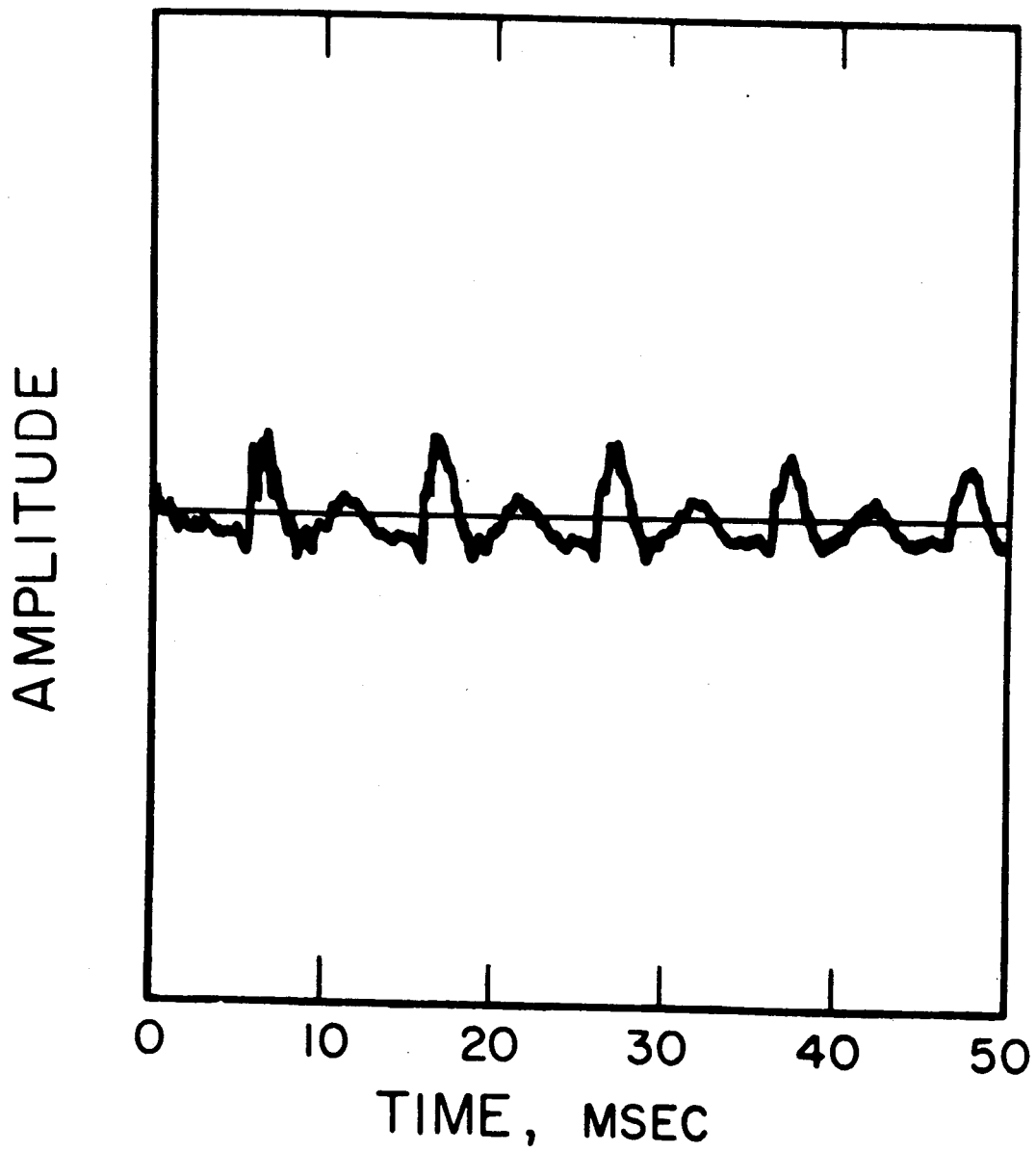
Figure 2:
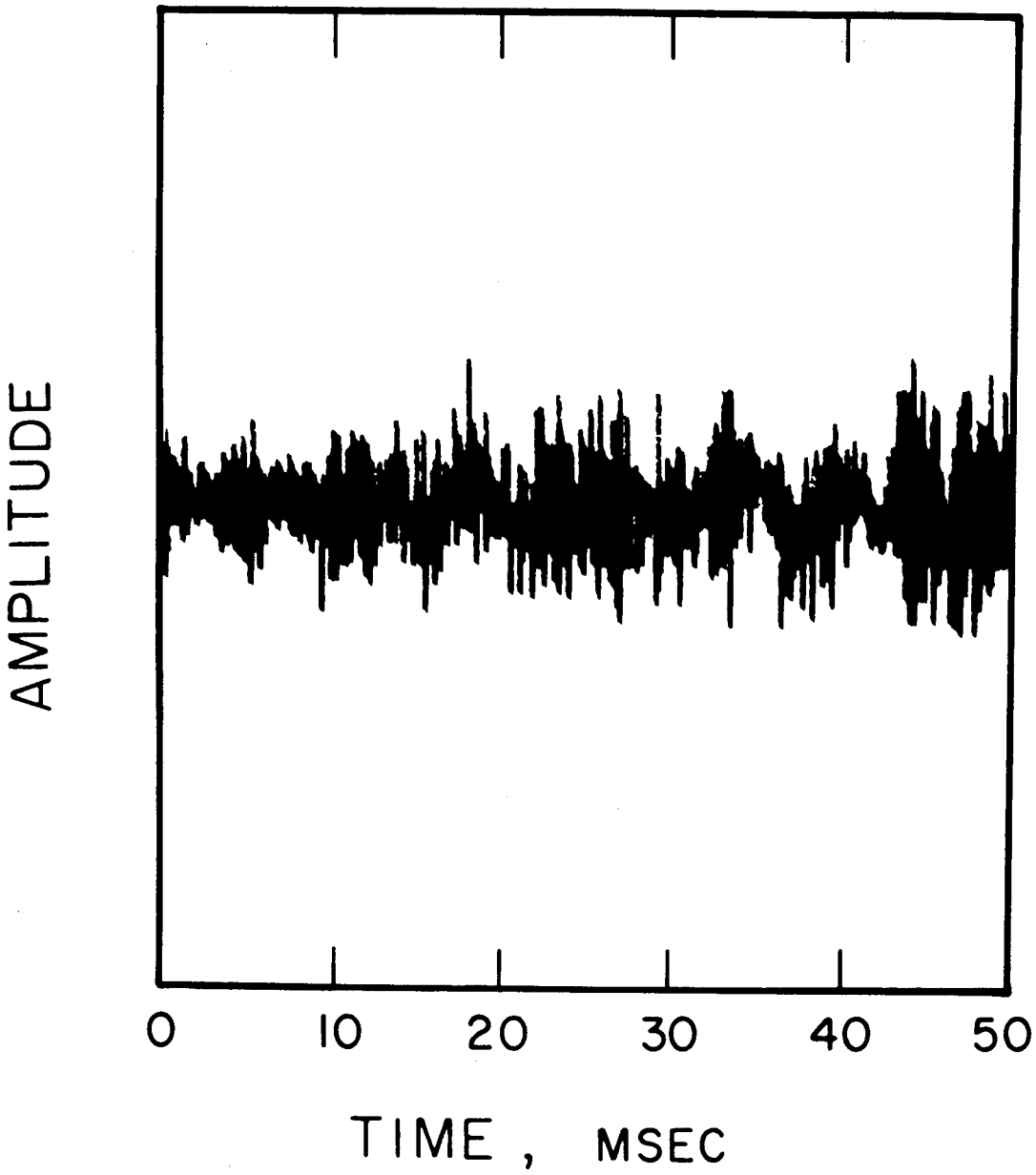
Figure 3:
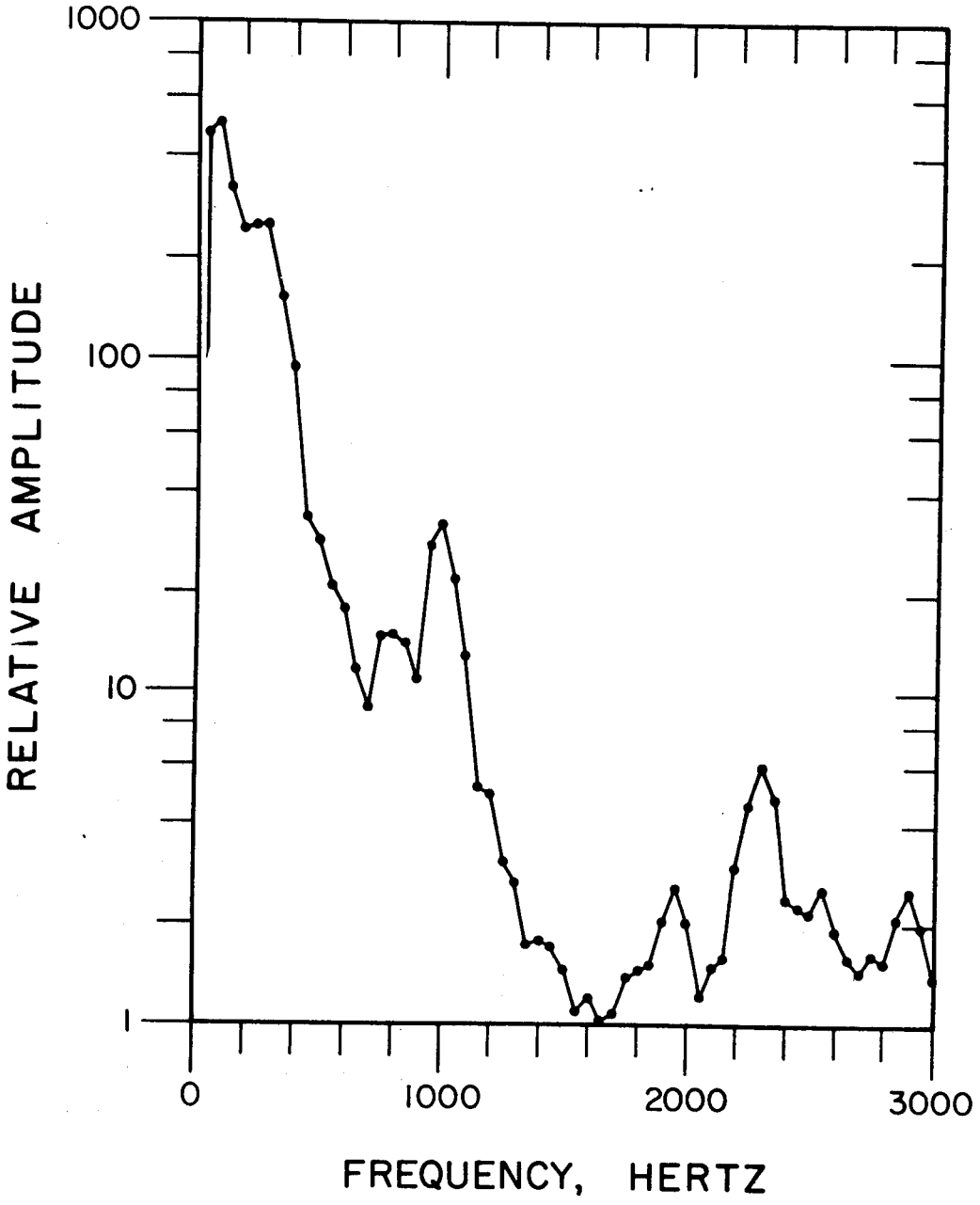
Figure 4:
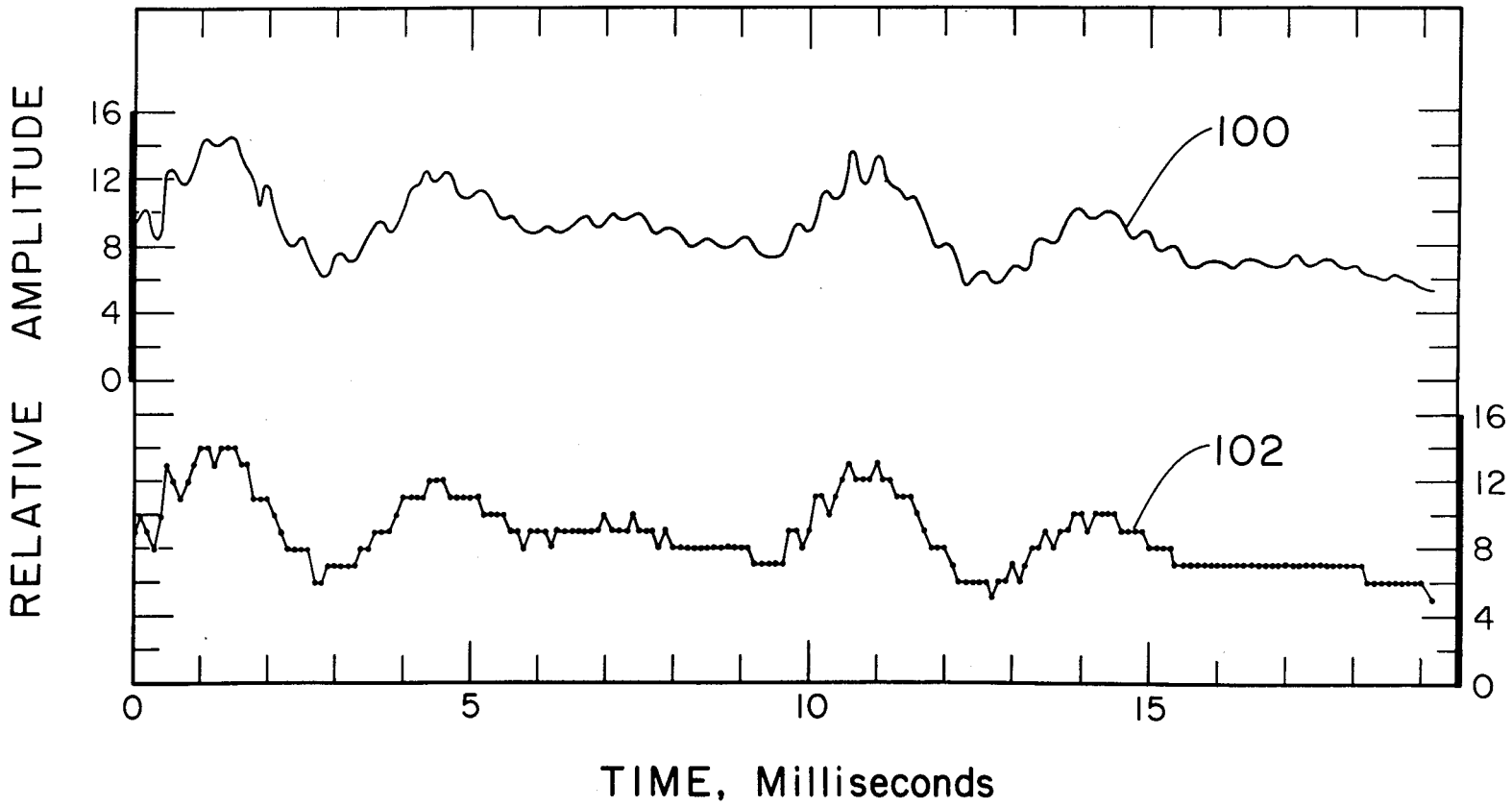
Figure 5:
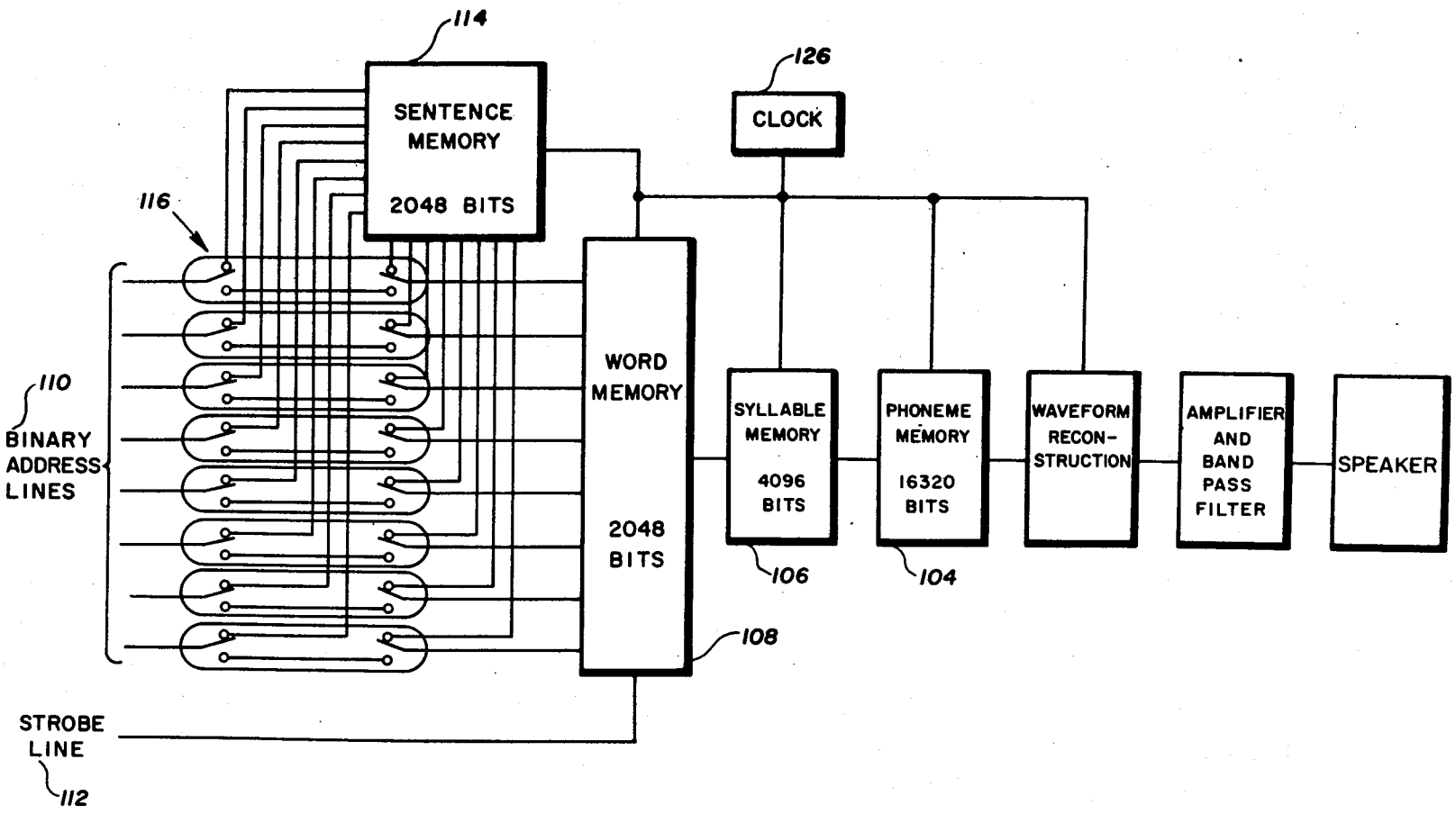
FIG. 5 is a simplified block diagram of a speech synthesizer illustrating the storage device of the present invention.
Figure 6:
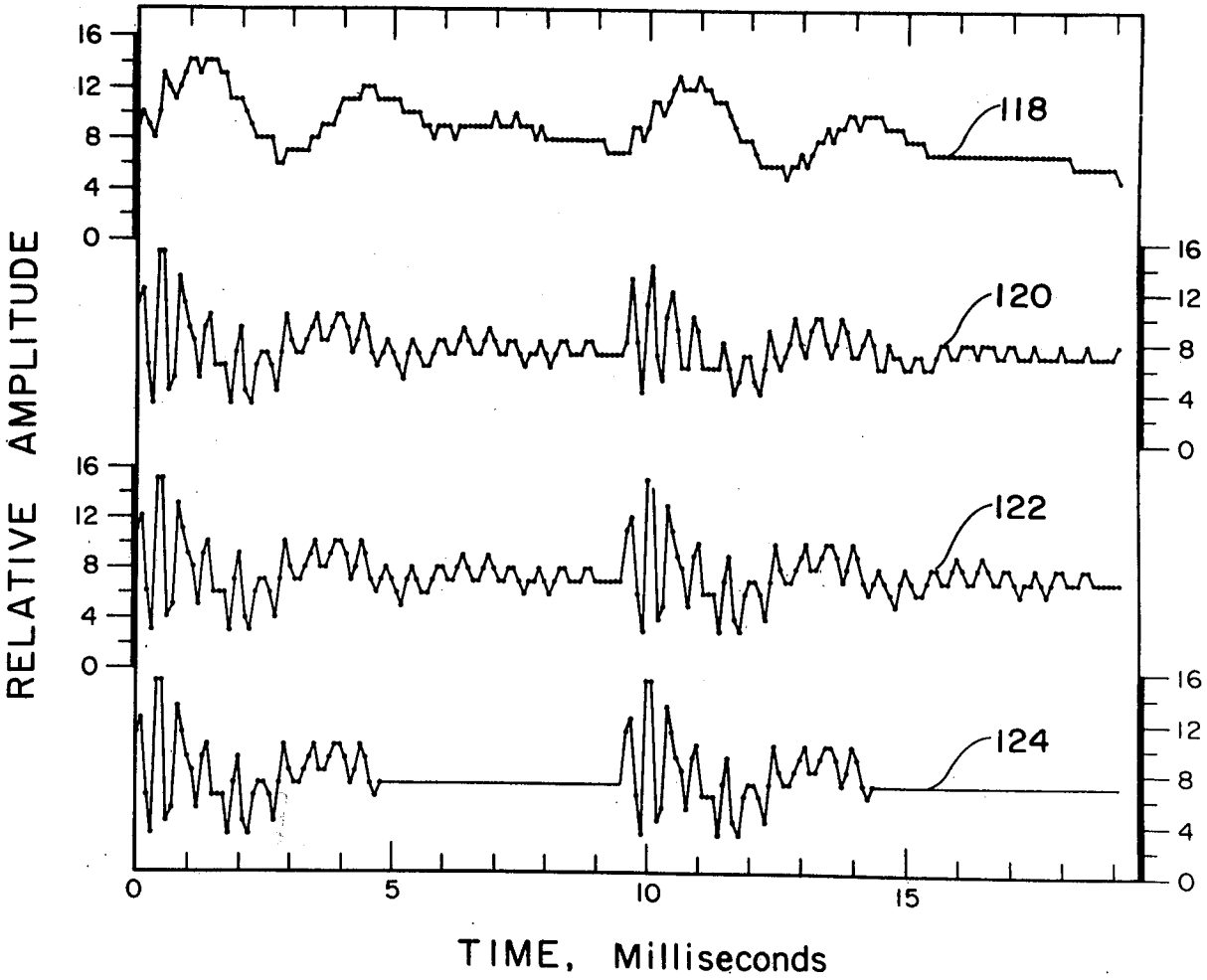
Figure 7:
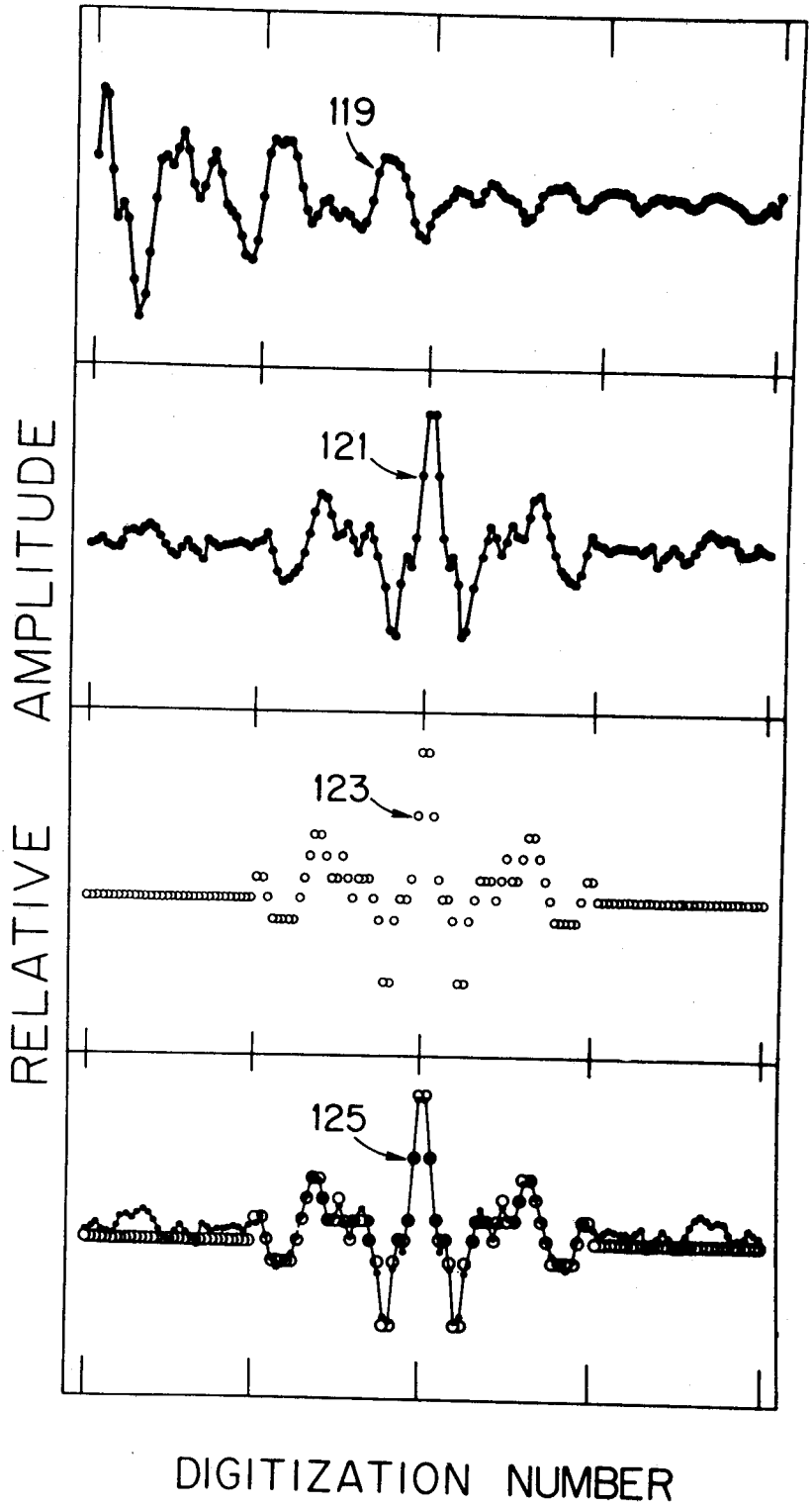
Figure 8:
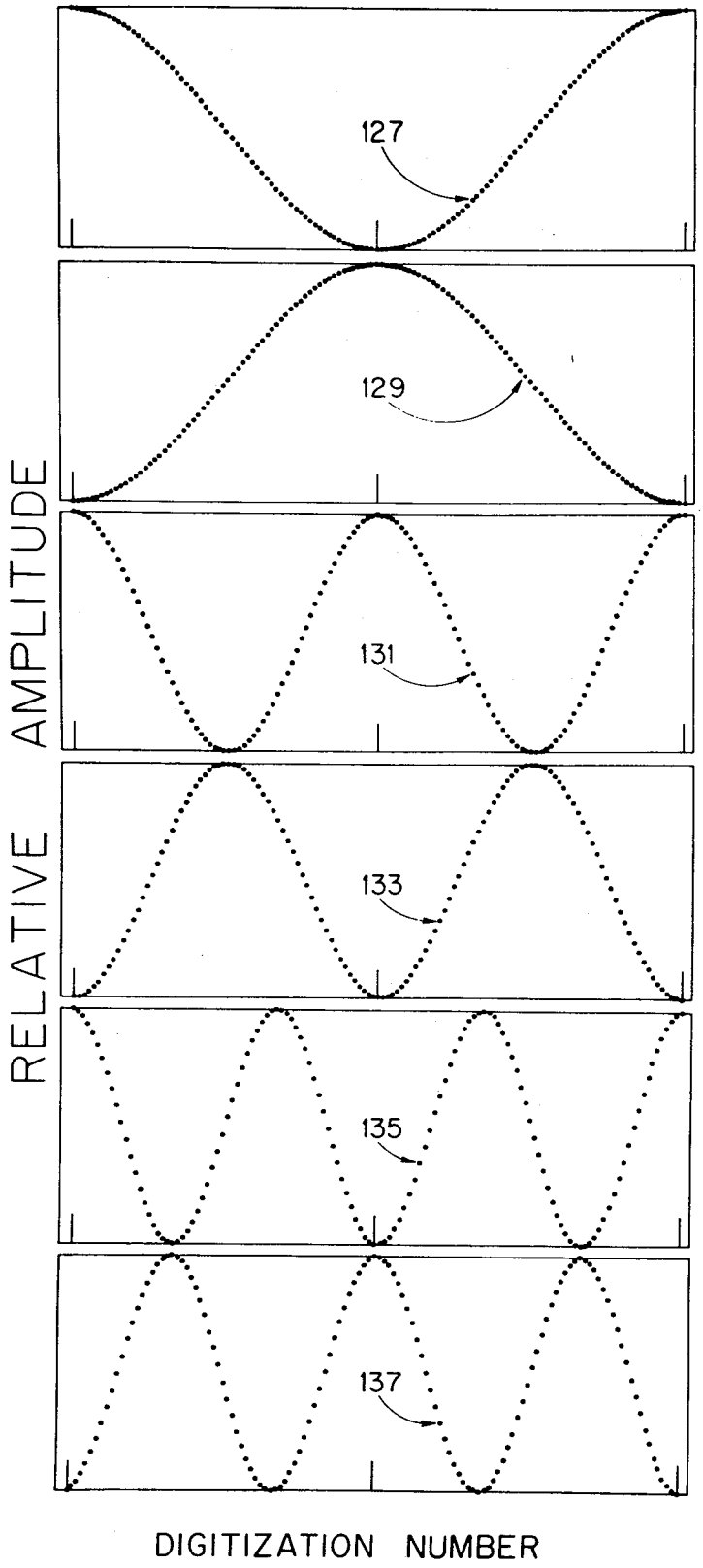

A block diagram of the preferred embodiment of the speech synthesizer 103 for use with the invention is given in FIG. 5. It should be understood, however, that the initial programming of the elements of this block diagram by means of a human operator and a digital computer will be discussed in detail in reference to FIG. 9. The synthesizer phoneme memory 104 stores the digital information pertinent to the compressed waveforms and contains 16,320 bits of information. The synthesizer syllable memory 106 contains information signals as to the locations in the phoneme memory 104 of the compressed waveforms of interest to the particular sound being produced and it also provides needed information for the reconstruction of speech from the compressed information in the phoneme memory 104. Its size is 4096 bits. The synthesizer word memory 108, where size is 2048 bits, contains signals representing the locations in the syllable memory 106 of information signals for the phoneme memory 104 which construct syllables that make up the word of interest.

To recreate the compressed speech information stored in the speech synthesizer a word is selected by impressing a predetermined binary address on the seven address lines 110. This word is then constructed electronically when the strobe line 112 is electrically pulsed by utilizing the information in the word memory 108 to locate the addresses of the syllable information in the syllable memory 106, and in turn, using this information to locate the address of the compressed waveforms in the phoneme memory 104 and to ultimately reconstruct the speech waveform from the compressed data and the reconstruction instructions stored in the syllable memory 106. The digital output from the phoneme memory 104 is passed to a delta-modulation decoder circuit 184 and thence through an amplifier 190 to a speaker 192. The diagram of FIG. 5 is intended only as illustrative of the basic functions of the synthesizer used with the invention; a more detailed description is given in reference to FIGS. 10 and 11*a*–11*f* in the referenced parent application.

Groups of words may be combined together to form sentences in the speech synthesizer through addressing a 2048 bit sentence memory 114 from a plurality of external address lines 110 by positioning seven, double-pole double-throw switches 116 electronically into the configuration illustrated in FIG. 5.

The selected contents of the sentence memory 114 then provide addresses of words to the word memory 108. In this way, the synthesizer is capable of counting from 1 to 40 and can also be operated to selectively say such things as: "3.5+7−6=4.5," "1942 over 0.0001=overflow," "2×4=8," "4.2 volts dc," "93 ohms," "17 amps ac," 11:37 and 40 seconds, 11:37 and 50 seconds," "3 up, 2 left, 4 down," "6 pounds 15 ounces equals 8 dollars and 76 cents," "55 miles per hour," and "2 miles equals 3218 meters, equals 321869 centimeters," for example.

COMPRESSION TECHNIQUES

As described above, the basic content of the memories 108, 106 and 104 is the end result of certain speech compression techniques subjectively applied by a human operator to digital speech information stored in a computer memory.

In actual practice, certain basic speech information necessary to produce the one hundred and twenty-eight word vocabulary is spoken by the human operator into a microphone, in a nearly monotone voice, to produce analog electrical signals representative of the basic speech information. These analog signals are next differentiated with respect to time. This information is then stored in a computer and is selectively retrieved by the human operator as the speech programming of the speech synthesizer circuit takes place by the transfer of the compressed data from the computer to the synthesizer. This process will be explained in greater detail hereinafter in reference to FIG. 9.

An example of the application of the floating-zero two-bit delta-modulation scheme is given in Table 5, in the second and third columns of which the amplitudes of the first twenty digitizations of a four-bit waveform are given in decimal and binary units. The two bits of delta-modulation information that would go into the phoneme memory 104 are next listed in decimal and binary, and, finally, the waveform that would be reconstructed by the prototype synthesizer from the compressed information in the phoneme memory 104 is given:

TABLE 5

| | Example of Delta Modulation | | | | | |
|---|---|---|---|---|---|---|
| Digitization | Amplitude of the Original Waveform | | Delta-Modulation Information ($\Delta_i$) | | Amplitude of the Reconstructed Waveform | |
| | Decimal | Binary | Decimal | Binary | Decimal | Binary |
| 1 | 10 | 1010 | 3 | 11 | 10 | 1010 |
| 2 | 13 | 1101 | 3 | 11 | 13 | 1101 |
| 3 | 14 | 1110 | 2 | 10 | 14 | 1110 |
| 4 | 15 | 1111 | 2 | 10 | 15 | 1111 |
| 5 | 15 | 1111 | 1 | 01 | 15 | 1111 |
| 6 | 13 | 1101 | 1 | 01 | 14 | 1110 |
| 7 | 9 | 1001 | 0 | 00 | 11 | 1011 |
| 8 | 7 | 0111 | 0 | 00 | 8 | 1000 |
| 9 | 5 | 0101 | 0 | 00 | 5 | 0101 |
| 10 | 4 | 0100 | 1 | 01 | 4 | 0100 |
| 11 | 5 | 0101 | 3 | 11 | 5 | 0101 |
| 12 | 7 | 0111 | 2 | 10 | 6 | 0110 |
| 13 | 10 | 1010 | 3 | 11 | 9 | 1001 |
| 14 | 13 | 1101 | 3 | 11 | 12 | 1100 |
| 15 | 10 | 1010 | 0 | 00 | 11 | 1011 |
| 16 | 8 | 1000 | 0 | 00 | 8 | 1000 |
| 17 | 5 | 0101 | 0 | 00 | 5 | 0101 |
| 18 | 3 | 0011 | 1 | 01 | 4 | 0100 |
| 19 | 2 | 0010 | 1 | 01 | 3 | 0011 |
| 20 | 2 | 0010 | 1 | 01 | 2 | 0010 |

As an example of the amount of compression achieved in the storage device according to the invention, the process of phase adjusting performed in the computer produces a factor of 3 compression, a factor of 2 of which comes from the necessity for storing only half the waveform and a factor of 1.5 comes from the improved usage of delta-modulation. A further advantage of phase adjusting is that it allows minimization of the power appearing in those parts of the waveform that are half-period zeroed. Thus, the compression factor achieved between an original analog domain speech period waveform and a phase adjusted, half period zeroed, and floating-zero-two-bit delta modulated compressed waveform is 12. Of this factor of 12, 2 results from half-period zeroing, 2 results from phase adjusting, and 3 results from the combination of phase adjusting and delta modulation.

THE SYNTHESIZER PHONEME MEMORY

The structure of the phoneme memory 104 is 96 bits by 256 words. This structure is achieved by placing 12 eight-bit read-only memorise in parallel to produce the 96-bit word structure. The memories are read sequentially, i.e., eight bits are read from the first memory, then eight bits are read from the second memory, etc., until eight bits are read from the twelfth memory to complete a single 96-bit word. These 96 bits represent 48 pieces of two-bit delta-modulated amplitude information that are electronically decoded in the manner described in Table 5 and its discussion. The electronic circuit for accomplishing this process will be described in detail, hereinafter, in reference to FIG. 10.

For purposes of simplification in the construction of the prototype speech synthesizer, the delta-modulated information corresponding to the second quarter of each phase adjusted ptich period of data is actually stored in the phoneme memory even though this information can be obtained by inverting the waveform of the first quarter of that pitch period. Thus, the prototype phoneme memory contains 24,576 bits of information instead of 16,320 bits that would be required if electronic means were provided to construct the second quarter of phase adjusted pitch period data from the first. It is emphasized that this approach was utilized to simplify construction of the prototype unit while at the same time providing a complete test of the system concept.

THE SYNTHESIZER SYLLABLE MEMORY

The structure of the syllable memory 106 is 16 bits by 256 words. This structure is achieved by placing two eight-bit read-only memories in parallel. The syllable memory 106 contains the information required to combine sequences of outputs from the phoneme memory 104 into syllables or complete words. Each 16-bit segment of the syllable memory 106 yields the following information

| Information | Number of Bits Required |
|---|---|
| Initial address in the phoneme memory of the phoneme of interest (0–127). This seven-bit number hereinafter is called p'. | 7 |
| Information whether to play the given phoneme or to play silence of an equal length. If the bit is a one, play silence. This logic variable is hereinafter called Y. | 1 |
| Information whether this is the last phoneme in the syllable. If the bit is a one, this is the last phoneme. This logic variable is hereinafter called G. | 1 |
| Information whether this phoneme is half-period zeroed. If the bit is a one, this phoneme is half-period zeroed. This logic variable is hereinafter called Z. | 1 |
| Number of repetitions of each pitch period. One to four repetitions are denoted by the binary numbers 00 to 11, and the decimal number ranging from one to four is hereinafter called m'. | 2 |
| Number of pitch periods of phoneme memory information to play out. One to sixteen periods are denoted by the binary numbers 0000 to 1111, and the decimal number ranging from one to sixteen is hereinafter called n'. | 4 |

THE SYNTHESIZER WORD MEMORY

The syllable memory 106 contains sufficient information to produce 256 phonemes of speech. The syllables thereby produced are combined into words by the word memory 108 which has a structure of eight bits by 256 words. By definition, each word contains two syllables, one of which may be a single pitch period of silence (which is not audible) if the particular word is made from only one syllable. Thus, the first pair of eight bit words in the word memory gives the starting locations in the syllable memory of the pair of syllables that make up the first word, the second pair of entries in the word memory gives similar information for the second word, etc. Thus, the size of the word memory 108 is sufficient to accommodate a 128-word vocabulary.

THE SENTENCE MEMORY

The word memory 108 can be addressed externally through its seven address lines 110. Alternatively, it may be addressed by a sentence memory 114 whose function is to allow for the generation of sequences of words that make sentences. The sentence memory 114 has a basic structure of 8 bits by 256 words. The first 7 bits of each 8-bit word give the address of the word of interest in the word memory 108 and the last bit provides information on whether the present word is the last word in the sentence. Since the sentence memory 114 contains 256 words, it is capable of generating one or more sentences containing a total of no more than 256 words.

Figure 9:
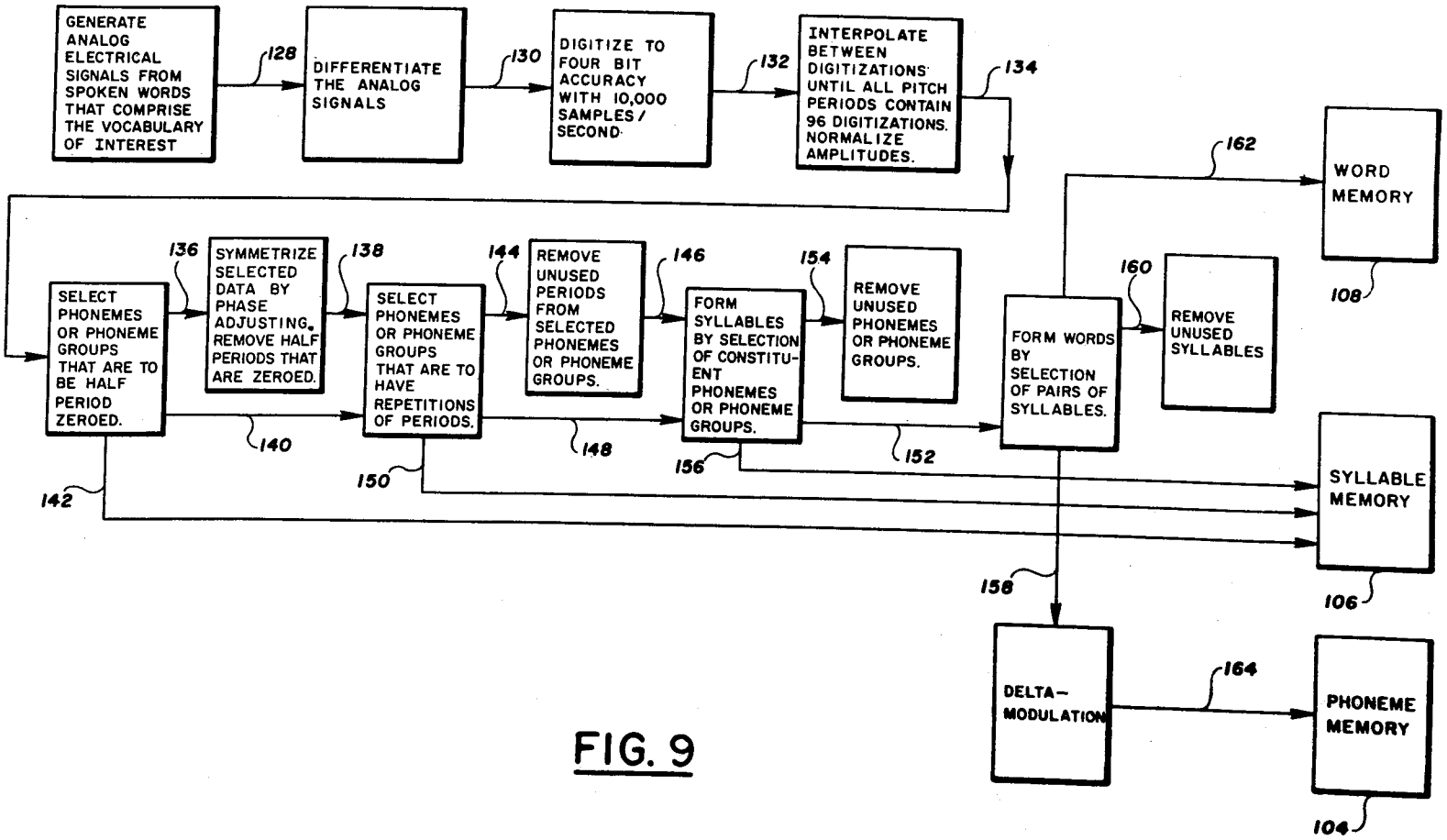
FIG. 9 is a block diagram illustrating the methods of analysis for generating the information in the phoneme, syllable, and word memories of the speech synthesizer storage device according to the invention.

Referring now more particularly to FIG. 9, a block diagram of the method by which the contents of the phoneme memory 104, the syllable memory 106, and the word memory 108 of the speech synthesizer 103 are produced is illustrated. As mentioned previously at pages 18 and 19, the degree of intelligibility of the compressed speech information upon reproduction is somewhat subjective and is dependent of the amount of digital storage available in the synthesizer. Achieving the desired amount of information signal compression while maximizing the quality and intelligibility of the reproduced speech thus requires a certain amount of trial and error use in the computer of the applicant's techniques described above until the user is satisified with the quality of the reproduced speech information.

To summarize the process by which the data for the synthesizer memories is generated in the computer, reference is made in particular to FIG. 9. The vocabulary of Table 2 is first spoken into a microphone whose output 128 is differentiated by a conventional electronic RC circuit to produce a signal that is digitized to 8-bit accuracy at a digitization rate of 10,000 samples/second by a commercially available analog to digital converter. This digitized waveform signal 132 is stored in the memory of a computer 133 where the signal 132 is expanded or contracted by linear interpolation between successive data points until each pitch period of voiced speech contains 96 digitization using straight-forward computer software. The amplitude of each word is then normalized by computer comparison to the amplitude of a reference phoneme to produce a signal having a waveform 134. See the discussion in the referenced parent application for a more complete description of these steps.

The phonemes or phoneme groups in this waveform that are to be half-period zeroed and phase adjusted are next selected by listening to the resulting speech, and these selected waveforms 136 are phase adjusted and half-period zeroed using conventional computer memory manipulation techniques and sub-routines to produce waveforms 138. See the referenced parent application, particularly pages 30–32 and 38–42 for a more complete description of these steps. The waveforms 140 that are chosen by the operator not to be half-period zeroed are left unchanged for the next compression stage while the information 142 concerning which phonemes or phoneme groups are half-period and phase adjusted is entered into the syllable memory 106 of the synthesizer 103.

the phoneme or phoneme groups 144 having pitch periods that are to be repeated are next selected by listening to the resulting speech which is reproduced by the computer and their unused pitch periods (that are replaced by the repetitions of the used pitch periods in reconstructing the speech waveform) are removed from the computer memory to produce waveforms 146. Those phoneme or phoneme groups 148 chosen by the operator to not have repeated periods by-pass this operation and the information 150 on the number of pitch-period repetitions required for each phoneme or phoneme group becomes part of the data transferred to the synthesizer syllable memory 106. See the discussion in the referenced parent application for a more complete description of these steps.

Syllables are next constructed from selected phonemes or phoneme groups 152 by listening to the resulting speech and by discarding the unused phonemes or phoneme groups 154. The information 156 on the phonemes or phoneme groups comprising each syllable become part of the sythesizer syllable memory 106. Words are next subjectively constructed from the selected syllables 158 by listening to the resulting speech, and the unused syllables 160 are discarded from the computer memory. The information 162 on the syllable pairs comprising each word is stored in the synthesizer word memory 108. See the referenced parent application, particularly pages 22–26 for a more complete description of these steps. The information 158 then undergoes delta modulation within the computer to decrease the number of bits per digitization from four to two; see the referenced parent application, particularly pages 33–38. The digital data 164, which is the fully compressed version of the initial speech, is transferred from the computer and is stored as the contents of the synthesizer phoneme memory 104.

The content of the synthesizer sentence memory 114, which is shown in FIG. 5 but is not shown in FIG. 9 to simplify the diagram, is next constructed by selecting sentences from combinations of the one hundred and twenty-eight possible words of Table 2. The locations in the word memory 108 of each word in the sequence of words comprising each sentence becomes the information stored in the synthesizer sentence memory 114. See the discussion supra for a more complete description of the phoneme, syllable and word memories.

Figure 10:
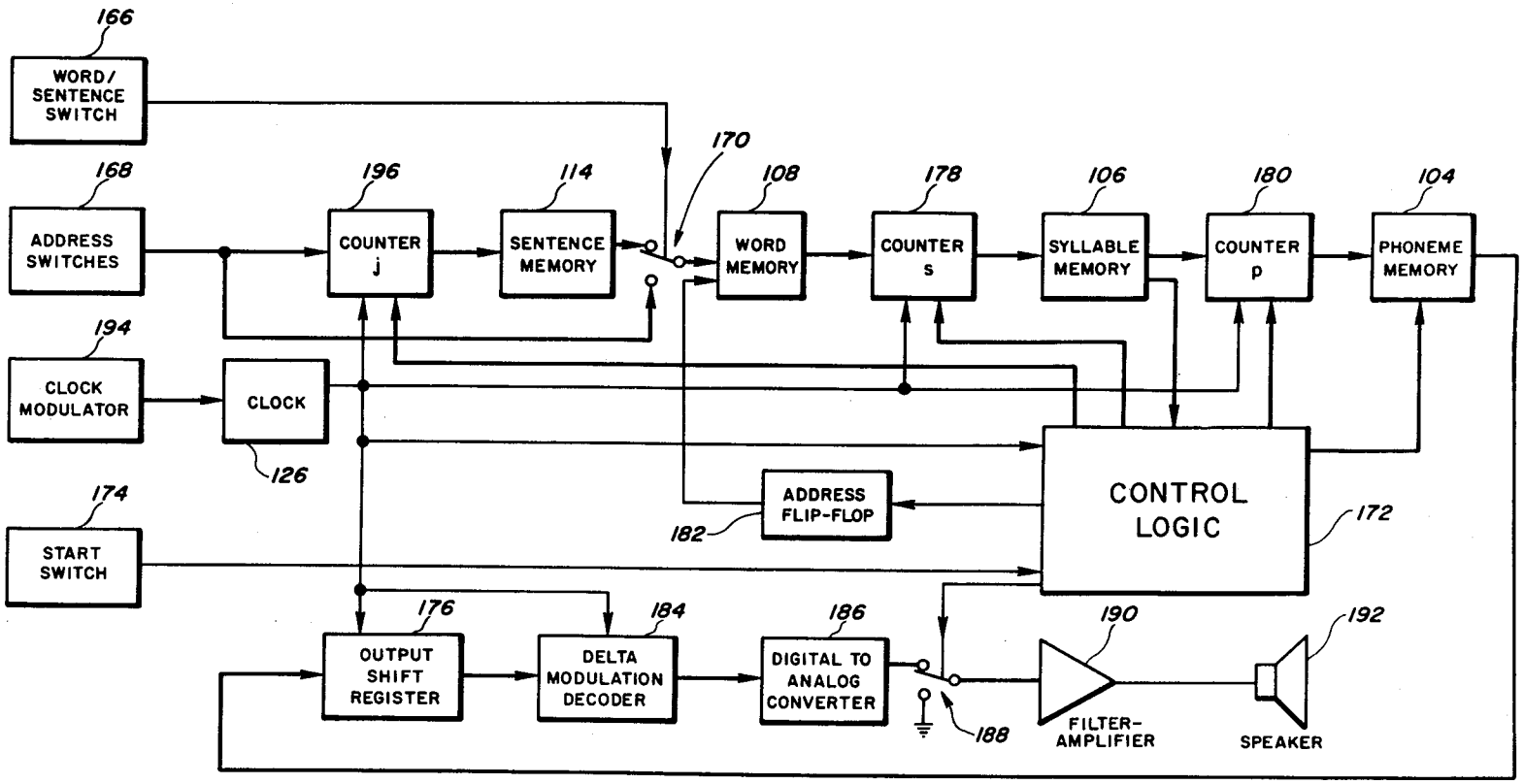
FIG. 10 is a block diagram of the synthesizer electronics used with the preferred embodiment of the invention.
Figure 11A:
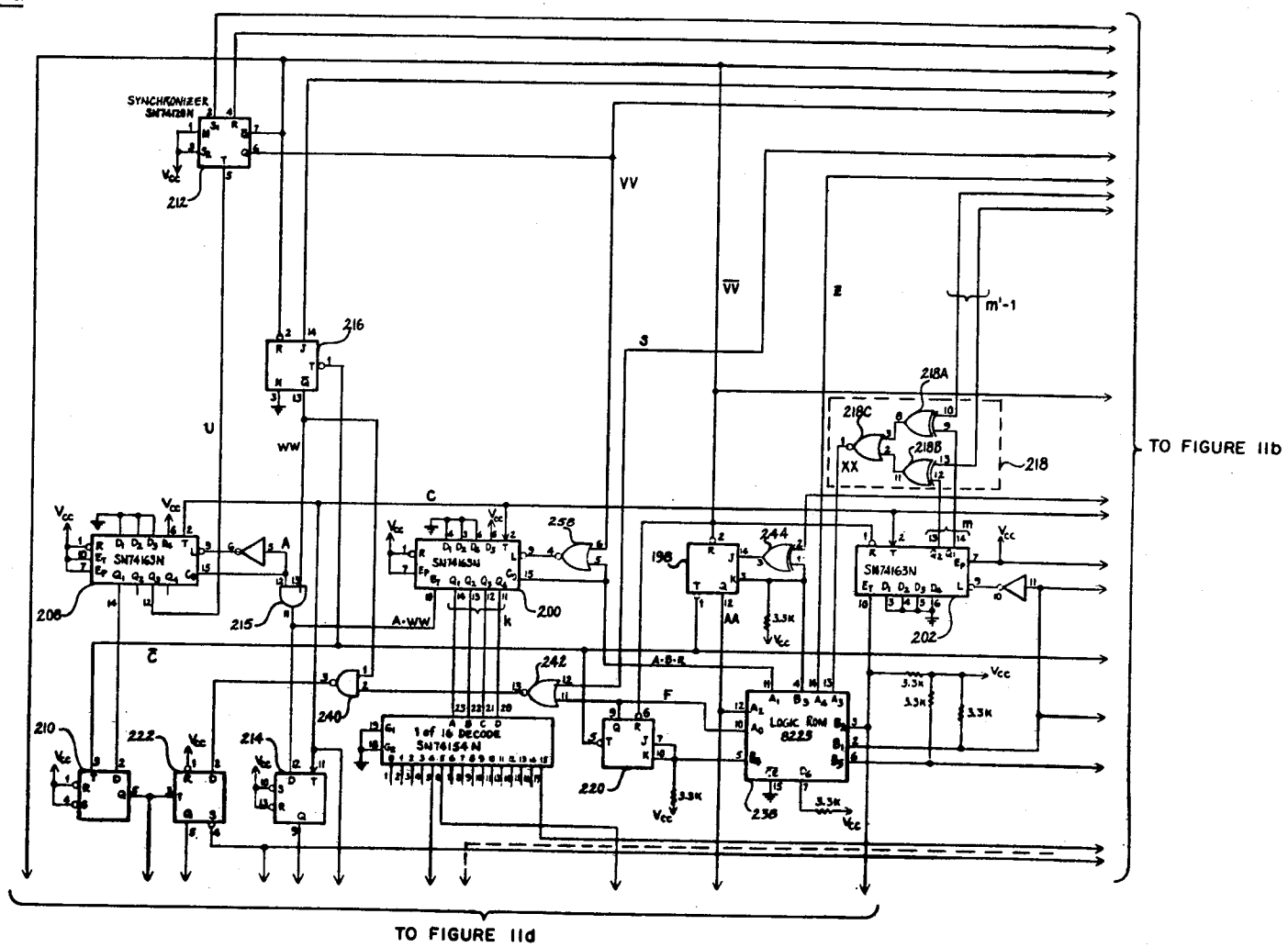
Figure 11B:
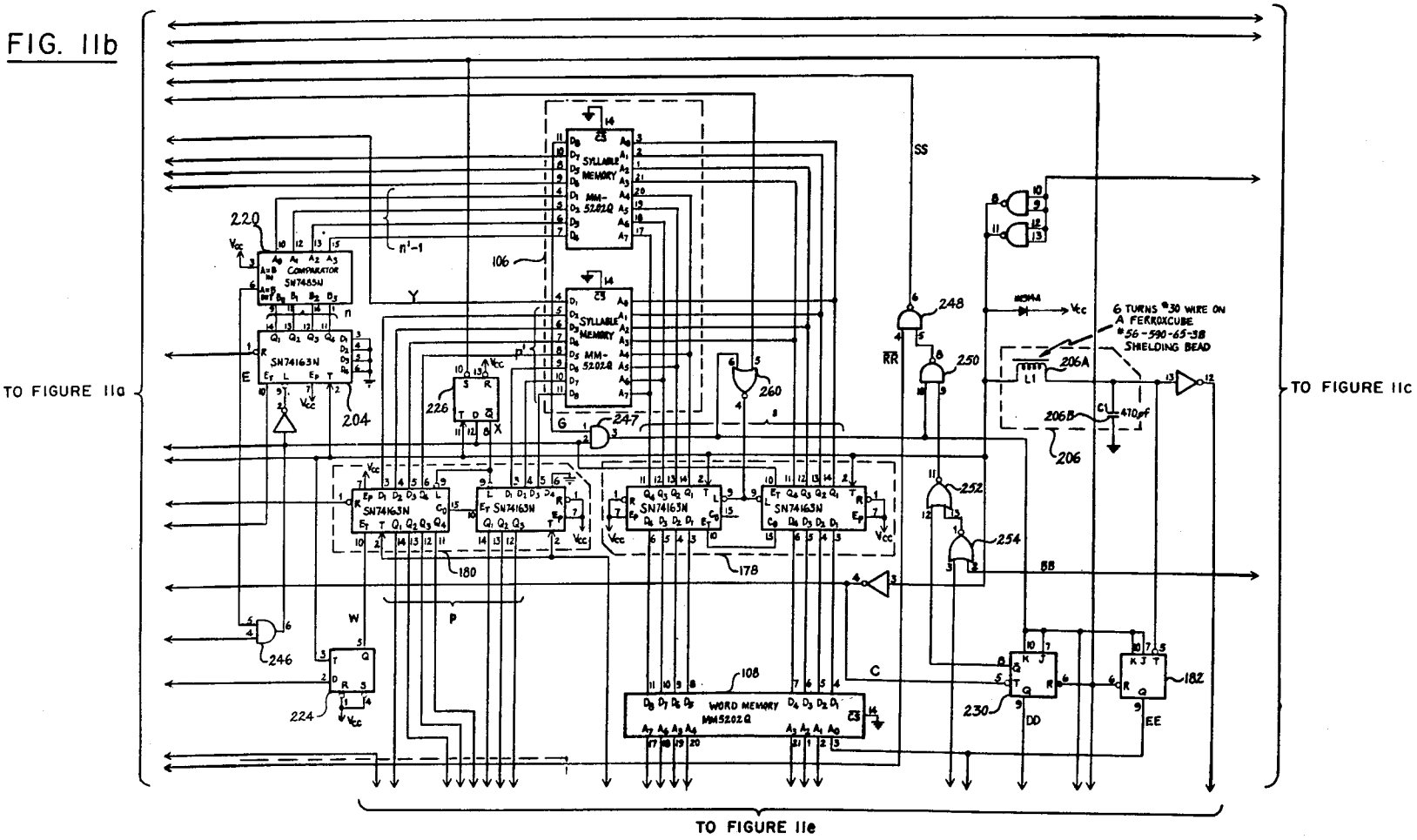
Figure 11C:
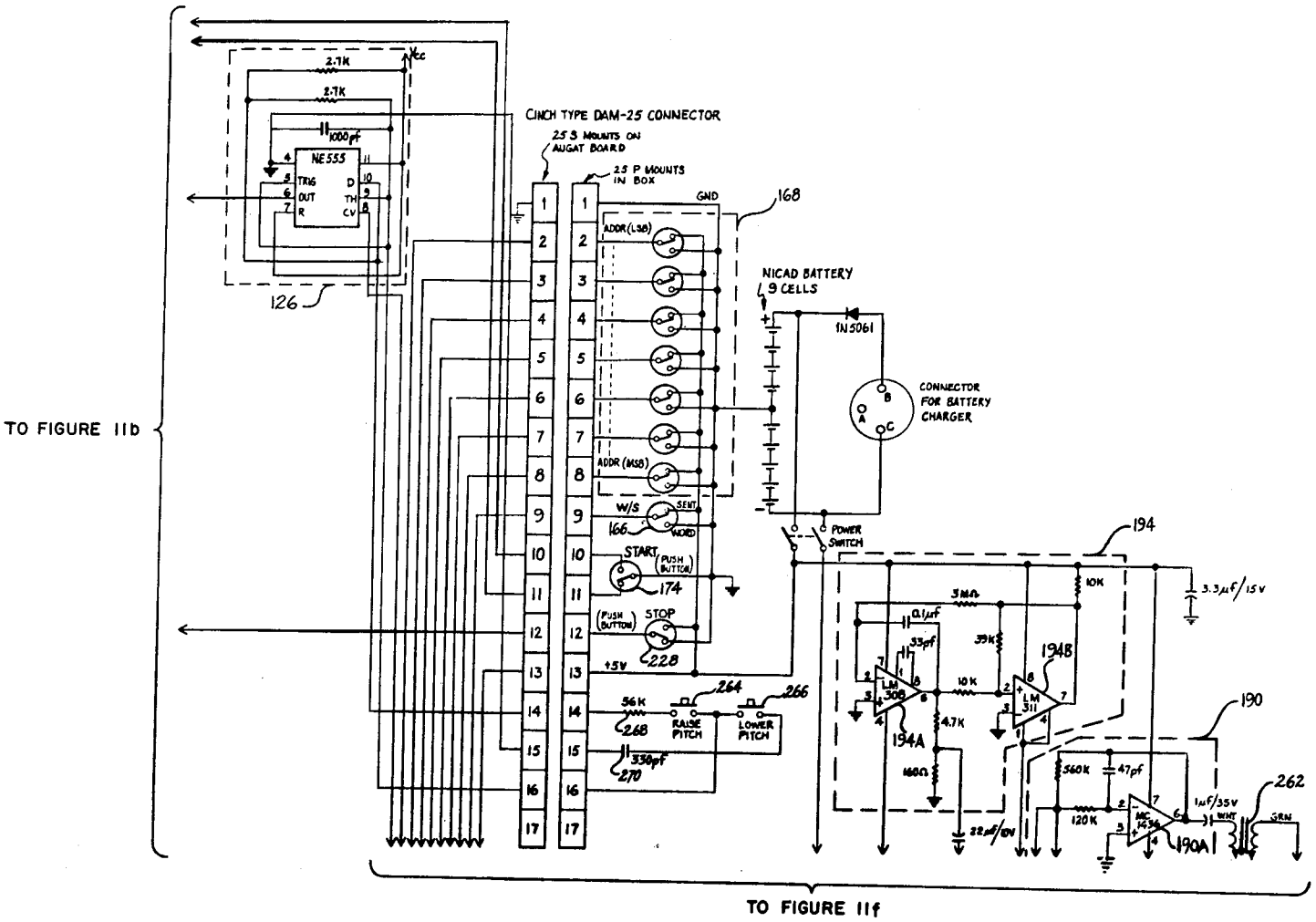
Figure 11E:
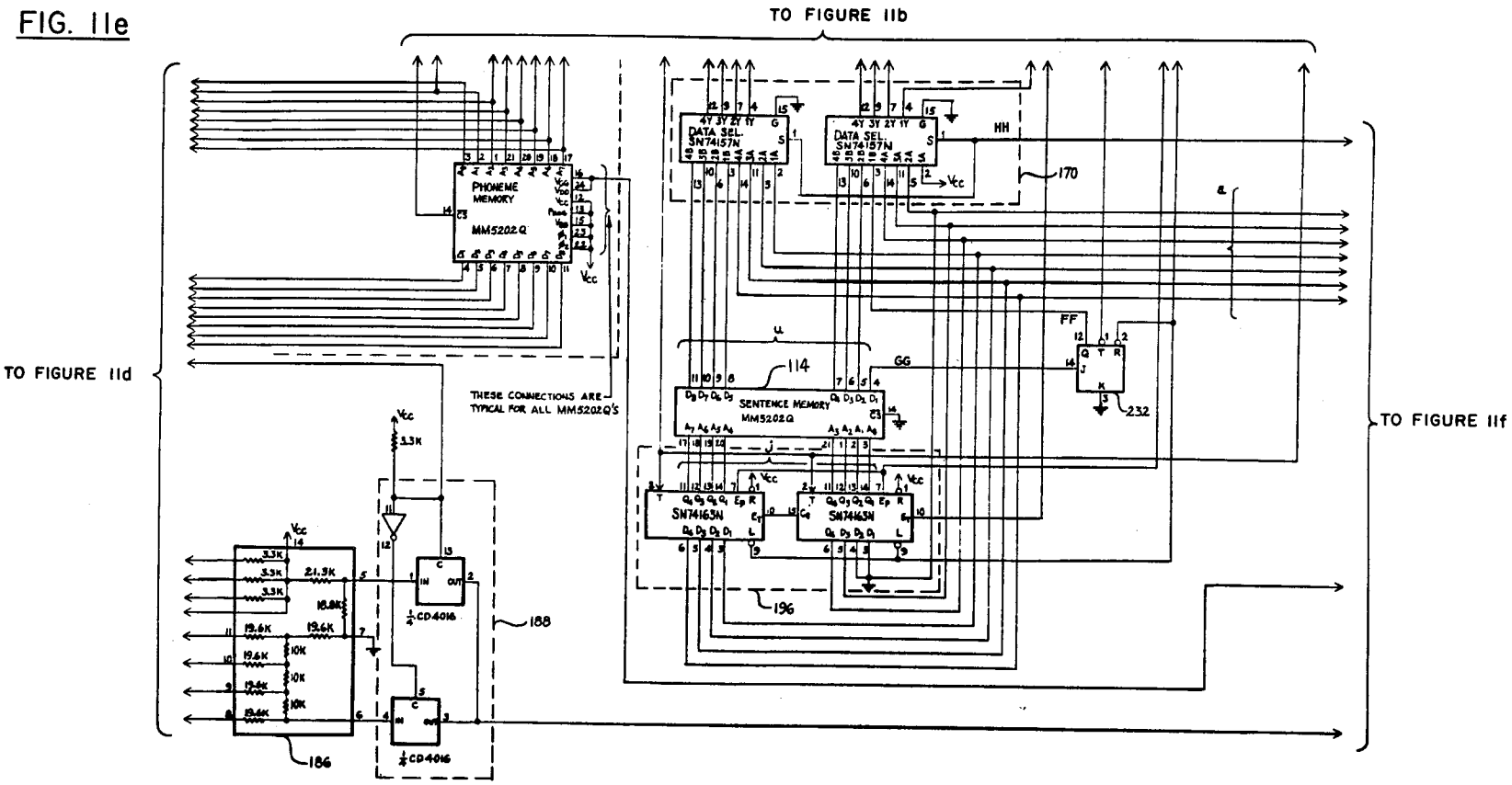
Figure 11F:
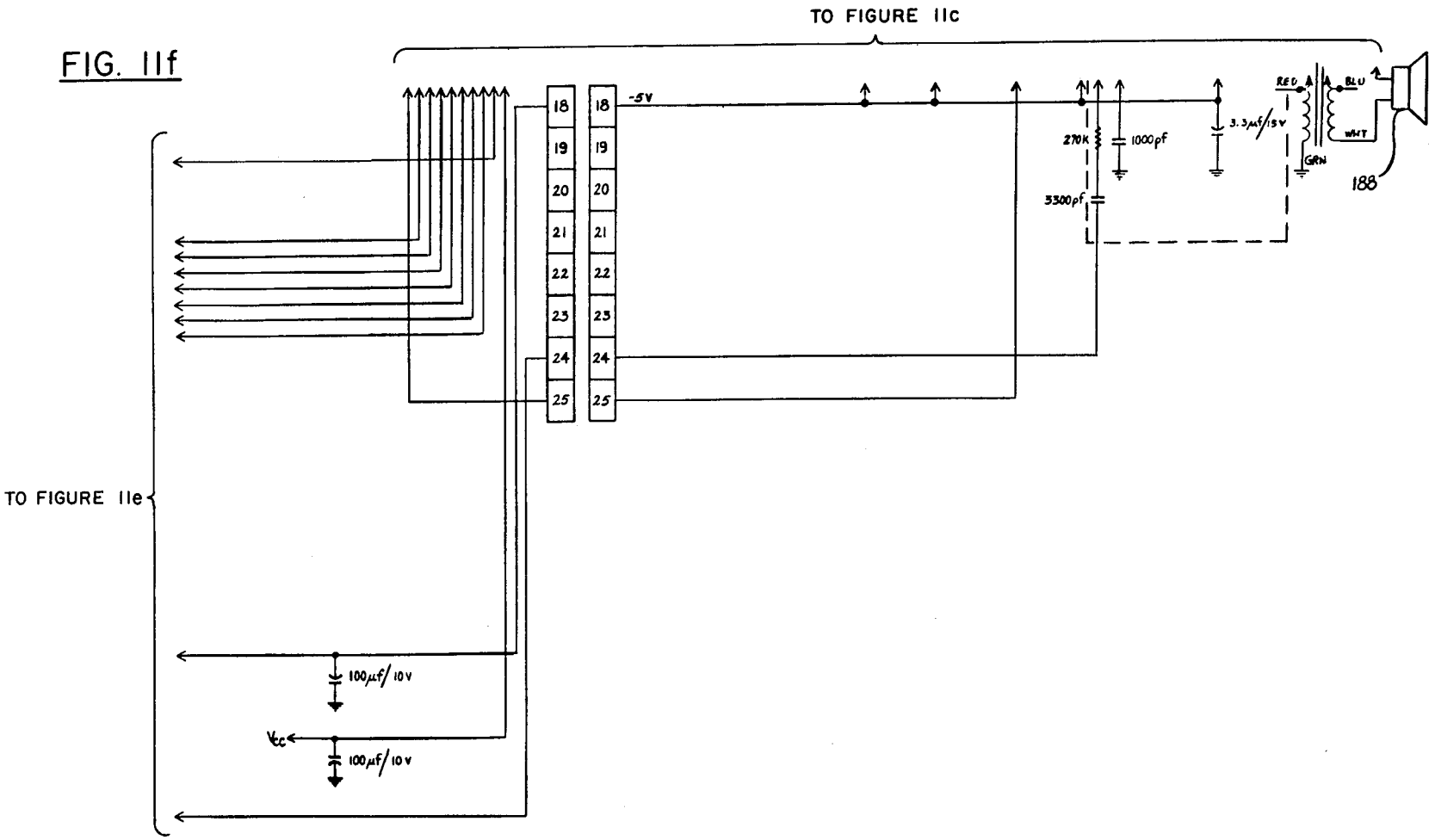
Figure 12:
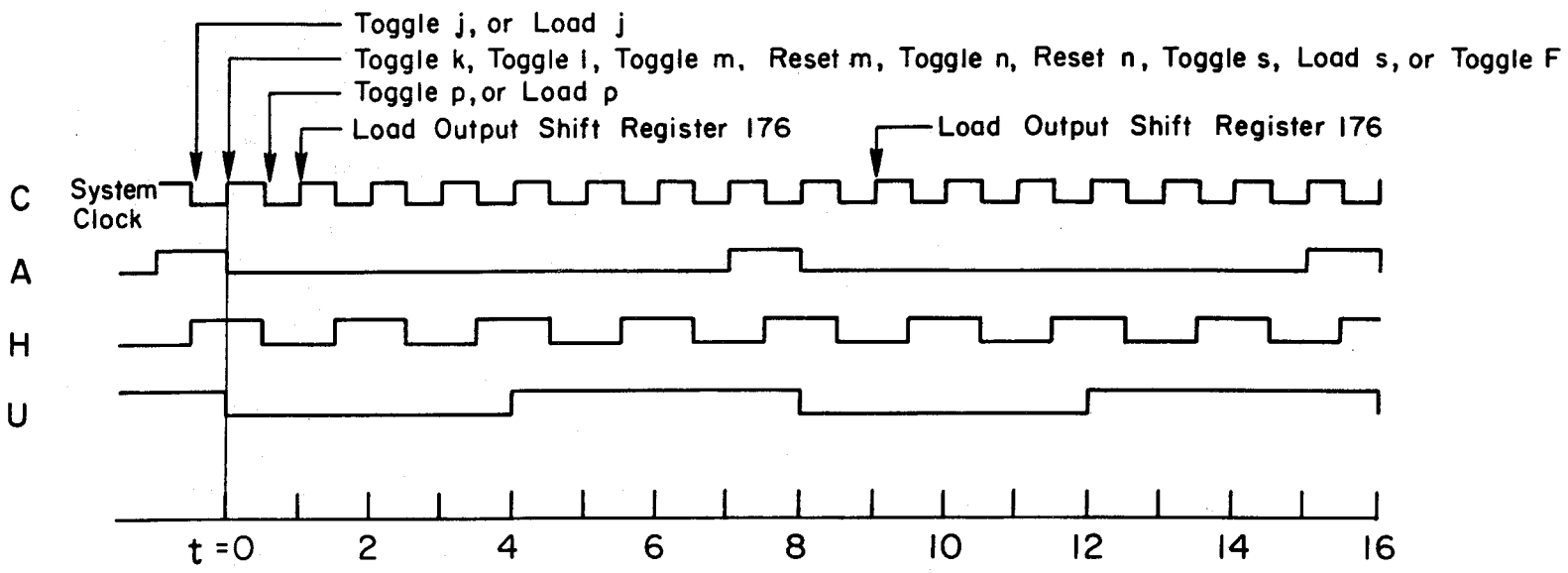
Figure 13:
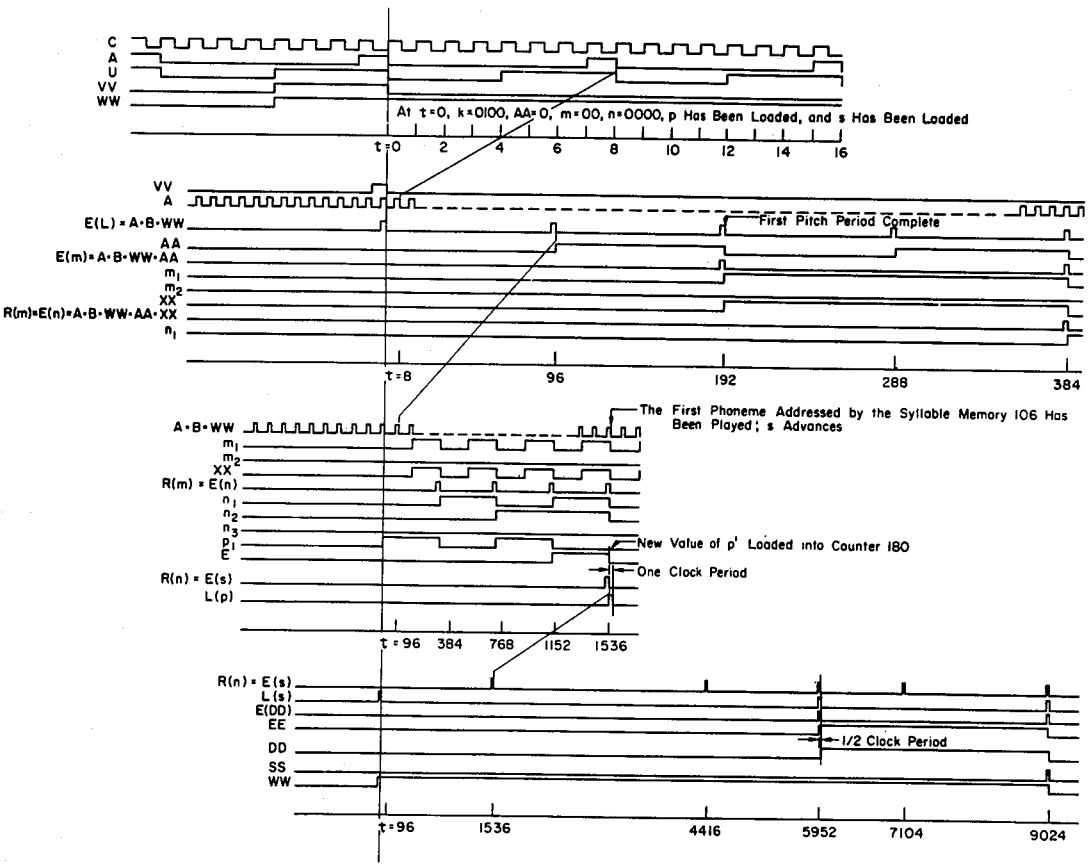
Figure 14:
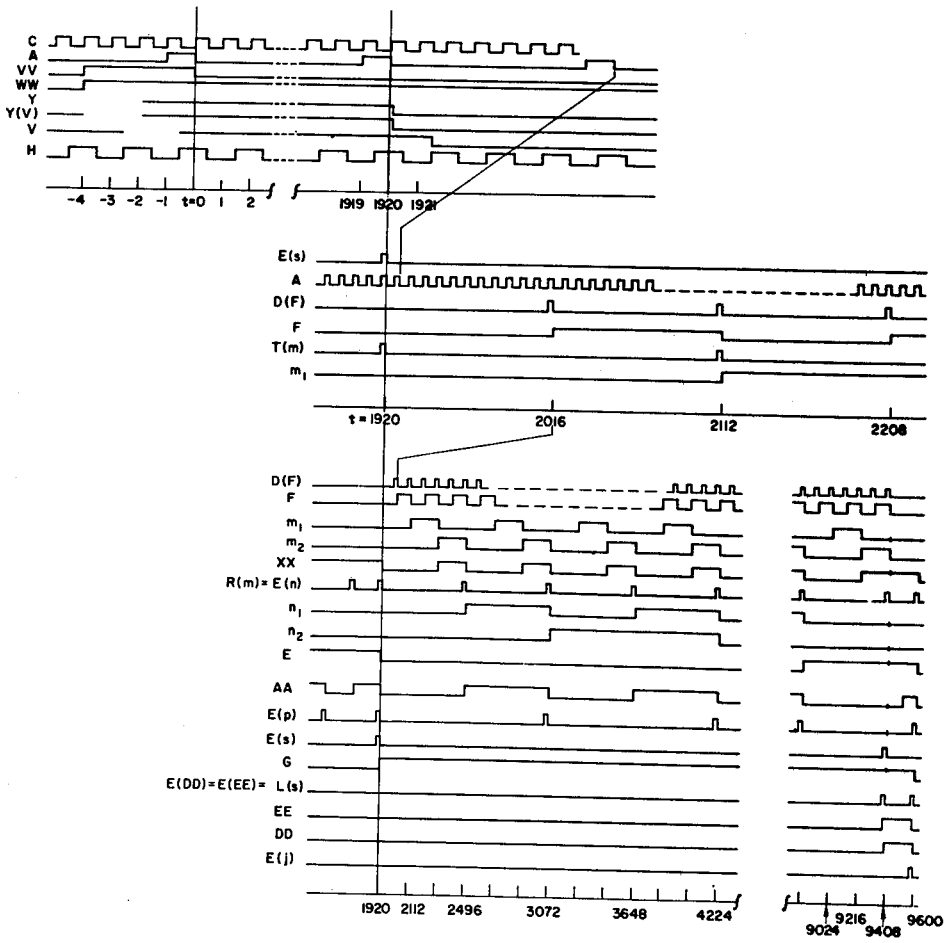
Figure 15:
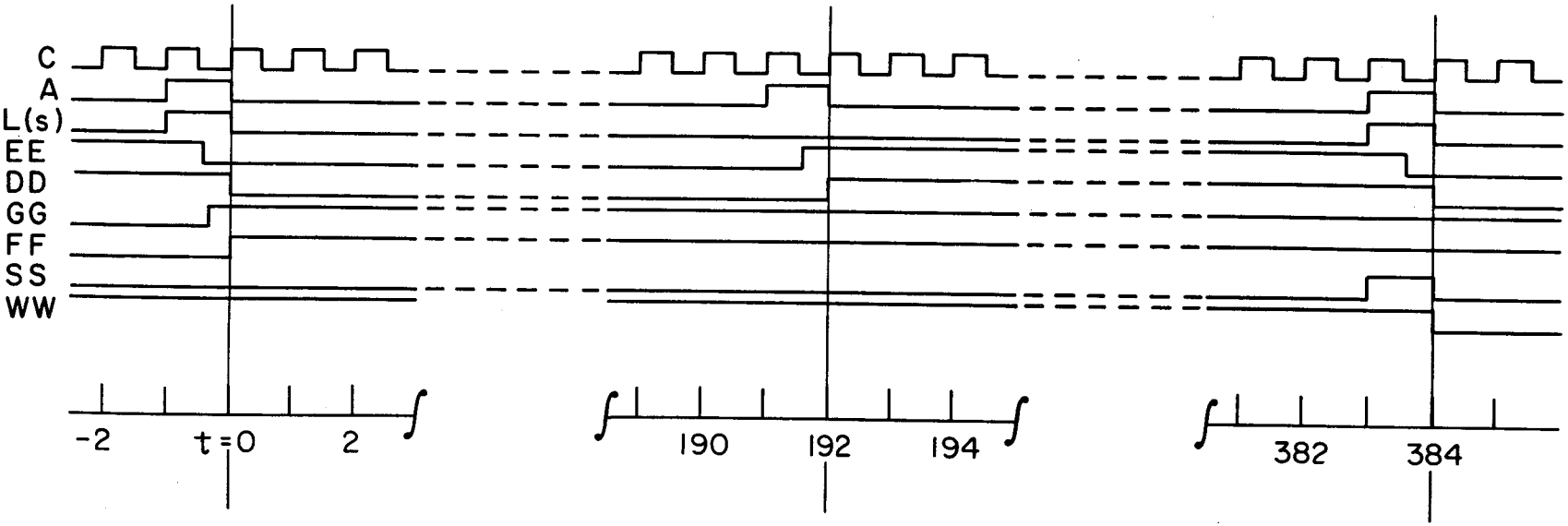
Figure 16:
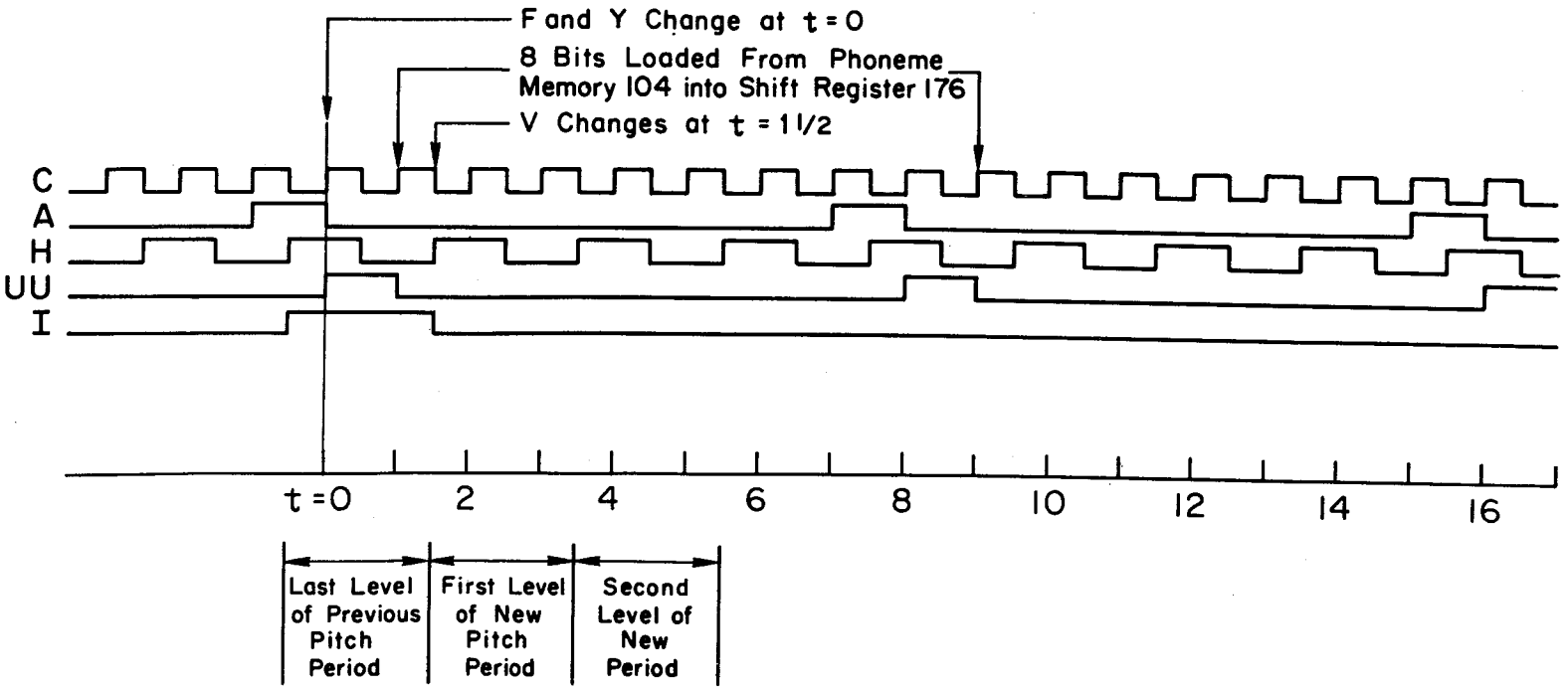

The electronic circuitry necessary to reproduce and thus synthesize the one hundred and twenty-eight word vocabulary will now be described in reference to FIG. 10. An overview of the operation of the synthesizer electronics is illustrated in the block diagram of FIG. 10. Depending on the state of the word/sentence switch 166, it is possible to address either individual words or entire sentences. Consider the former case. With the word/sentence switch 166 in the "word" position, the seven address switches 168 are connected directly through the data selector switch 170 to the address input of the word memory 108. Thus the number set into the switches 168 locates the address in the word memory 108 of the word which is to be spoken.

The output of the word memory 108 addresses the location of the first syllable of the word in the syllable memory 106 through a counter 178. The output of the syllable memory 106 addresses the location of the first phoneme of the syllable in the phoneme memory 104 through a counter 180. The purpose of the counters 178 and 180 will be explained in greater detail below. The output of the syllable memory 106 also gives information to a control logic circuit 172 concerning the compression techniques used on the particular phoneme. (The exact form of this information is detailed in the description of the syllable memory 106 above.)

When a start switch 174 is closed, the control logic 172 is activated to begin shifting out the contents of the phoneme memory 104, with appropriate decompression procedures, through the output of a shift register 176 at a rate controlled by the clock 126. When all of the bits of the firts phoneme have been shifted out (the instructions for how many bits to take for a given phoneme are part of the information stored in the syllable memory 106), the counter 178, whose output is the 8-bit binary number s, is advanced by the control logic 172 and the counter 180, whose output is the 7-bit binary number p, is loaded with the beginning address of the second phoneme to be reproduced.

When the last phoneme of the first syllable has been played, a type J-K flip-flop 182 is toggled by the control logic 172, and the address of the word memory 108 is advanced one bit to the second syllable of the word. The output of the word memory 108 now addresses the location of the beginning of the second syllable in the syllable memory 106, and this number is loaded into the counter 178. The phonemes which comprise the second syllable of the word which is being spoken are next shifted through the shift register 176 in the same manner as those of the first syllable. When the last phoneme of the second syllable has been spoken, the machine stops.

The operation of the control logic 172 is sufficiently fast that the stream of bits which is shifted out of the shift register 176 is continuous, with no pauses between the phonemes. This bit stream is a series of 2-bit pieces of delta-modulated amplitude information which are operated on by a delta-modulation decoder circuit 184 to produce a 4-bit binary number $v_i$ which changes 10,000 times each second. A digital to analog converter 186, which is a standard R-2R ladder circuit, converts this changing 4-bit number into an analog representation of the speech waveform. An electronic switch 188, shown connected to the output of the digital to analog converter 186, is toggled by the control logic 172 to switch the system ouput to a constant level signal which provides periods of silence within and between words, and within certain pitch periods in order to perform $\frac{1}{2}$-period operation. The control logic 172 receives its silence instructions from the syllable memory 106. This output from the switch 188 is filtered to reduce the signal at the digitizing frequency and the pitch period repetition frequency by the filter-amplifier 190, and is reproduced by the loudspeaker 192 as the spoken word of the vocabulary which was selected. The entire system is controlled by a 20 kHz clock 126, the frequency of which is modulated by a clock modulator 194 to break up the monotone quality of the sound which would otherwise be present as discussed above.

The operation of the synthesizer 103 with the word/-sentence switch 166 in the "sentence" position is similar to that described above except that the seven address switches 168 specify the location in the sentence memory 114 of the beginning of the sentence which is to be spoken. This number is loaded into a counter 196 whose output is an 8-bit number j which forms the address of the sentence memory 114. The output of the sentence memory 114 is connected through the data selector switch 170 to the address input of the word memory 108. The control logic 172 operates in the manner described above to cause the first word in the sentence to be spoken, then advances the counter 196 by one count and in a similar manner causes the second word in the sentence to be spoken. This continues until a location in the sentence memory 114 is addressed which contains a stop command, at which time the machine stops.

To further understand the operation of the prototype electronics, the actual contents of the various memories involved in the construction of a specific word will be examined. Again, it must be understood that the data making up these memory contents was originally generated in the computer 133 by a human operator using the applicant's speech compression methods and then was permanently transferred to the respective memories of the synthesizer 103 (See FIG. 9). Consider as an example the word "three". It is addressed by the seventh entry in the word memory 108; the contents of this location are, in the binary notation, 00000111. This is the beginning address of the first syllable of the word "three" in the syllable memory 106. The address 00000111 in binary or 7 in decimal refers to the eighth entry in the syllable memory 106, which is the binary number 00100000 00000110. Returning to the description of the syllable memory 106 on page 36, it is found that p'=0010000, which are the 7 most significant bits of the address in the phoneme memory 104 where the first phoneme of the first syllable starts. This address is the beginning location of the sound "th" in the phoneme memory 104.

The eighth bit from the syllable memory 106 vies Y=0, which means that this phoneme is not silence. The ninth bit gives G=0, which means that this is not the last phoneme in the syllable. The tenth bit gives Z=0, which means half-period zeroing is not used. The eleventh and twelfth bits give m'=1, the number of times each pitch period of sound is to be repeated. The last four bits give n'−1=0110 in binary so that n'=7 in decimal units, which is the total number of pitch periods of sound to be taken for this phoneme. Since G=0 for the first phoneme, we go to the next entry in the syllable memory 106 to get the information for the next phoneme.

The next entry is also 00100000 00000110. This means that the second phoneme that is produced is also "th". Since G=0, we go to the next entry in the syllable memory 106 to get information for the third phoneme. The next entry is 00101110 11101001. Thus, p'=0010111, Y=0, G=1, Z=1, m'=decimal 3, and n'=decimal 10. The number 0010111 is the starting address of "ree" in the phoneme memory 104. The equality G=1 indicates that this is the last phoneme of the syllable. Since Z=1, this indicates that ½period zeroing was done on this phoneme in the computer 103 and a half pitch period of silence must be generated in the synthesizer 103. Similarly, the equality m'=3 means each period of sound is to be repeated 3 times, and n'=10 means that a total of ten periods from the phoneme memory 104 are to be played. Since this was the last phoneme in the first syllable of the word which is being spoken, the address of the beginning of the second syllable in the syllable memory 106 will be found at the next entry in the word memory 108.

The next entry in the word memory 108 is 10000011. Since the binary number 10000011= decimal 131, the desired information is obtained from the 131st binary word of the syllable memory 106, which is 00000001 10000000. Thus, p'=0000000, Y=1, G=1, Z=0, m'=1, and n'=1. Since Y=1, this phoneme plays only silence; since m'=n'=1, it lasts for a total of one pitch period; and since G=1, this is the last phoneme in the syllable. Since this was the second syllable of the word, the synthesizer stops.

TABLE 7

Binary Contents of the Logic Read-Only Memory 238

| | $A_0$ | $A_1$ | $A_2$ | $A_3$ | $A_4$ | $B_1$ | $B_2$ | $B_3$ | $B_4$ | $B_5$ |
|---|---|---|---|---|---|---|---|---|---|---|
| 0 | 0 | 0 | 0 | 0 | 0 | 0 | 0 | 0 | 0 | 0 |
| 1 | 0 | 0 | 0 | 0 | 1 | 0 | 0 | 0 | 0 | 0 |
| 2 | 0 | 0 | 0 | 1 | 0 | 0 | 0 | 0 | 0 | 0 |
| 3 | 0 | 0 | 0 | 1 | 1 | 0 | 0 | 0 | 0 | 0 |
| 4 | 0 | 0 | 1 | 0 | 0 | 0 | 0 | 0 | 0 | 0 |
| 5 | 0 | 0 | 1 | 0 | 1 | 0 | 0 | 0 | 0 | 0 |
| 6 | 0 | 0 | 1 | 1 | 0 | 0 | 0 | 0 | 0 | 0 |
| 7 | 0 | 0 | 1 | 1 | 1 | 0 | 0 | 0 | 0 | 0 |
| 8 | 0 | 1 | 0 | 0 | 0 | 0 | 0 | 1 | 0 | 0 |
| 9 | 0 | 1 | 0 | 0 | 1 | 0 | 0 | 0 | 1 | 0 |
| 10 | 0 | 1 | 0 | 1 | 0 | 0 | 0 | 1 | 0 | 0 |
| 11 | 0 | 1 | 0 | 1 | 1 | 0 | 0 | 0 | 1 | 0 |
| 12 | 0 | 1 | 1 | 0 | 0 | 0 | 1 | 1 | 0 | 0 |
| 13 | 0 | 1 | 1 | 0 | 1 | 0 | 0 | 0 | 1 | 0 |
| 14 | 0 | 1 | 1 | 1 | 0 | 1 | 1 | 1 | 0 | 1 |
| 15 | 0 | 1 | 1 | 1 | 1 | 0 | 0 | 0 | 1 | 0 |
| 16 | 1 | 0 | 0 | 0 | 0 | 0 | 0 | 0 | 0 | 0 |
| 17 | 1 | 0 | 0 | 0 | 1 | 0 | 0 | 0 | 0 | 0 |
| 18 | 1 | 0 | 0 | 1 | 0 | 0 | 0 | 0 | 0 | 0 |
| 19 | 1 | 0 | 0 | 1 | 1 | 0 | 0 | 0 | 0 | 0 |
| 20 | 1 | 0 | 1 | 0 | 0 | 0 | 0 | 0 | 0 | 0 |
| 21 | 1 | 0 | 1 | 0 | 1 | 0 | 0 | 0 | 0 | 0 |
| 22 | 1 | 0 | 1 | 1 | 0 | 0 | 0 | 0 | 0 | 0 |
| 23 | 1 | 0 | 1 | 1 | 1 | 0 | 0 | 0 | 0 | 0 |
| 24 | 1 | 1 | 0 | 0 | 0 | 0 | 0 | 1 | 0 | 0 |
| 25 | 1 | 1 | 0 | 0 | 1 | 0 | 1 | 0 | 1 | 0 |
| 26 | 1 | 1 | 0 | 1 | 0 | 0 | 0 | 1 | 0 | 0 |
| 27 | 1 | 1 | 0 | 1 | 1 | 1 | 1 | 1 | 1 | 0 |
| 28 | 1 | 1 | 1 | 0 | 0 | 0 | 1 | 1 | 0 | 0 |
| 29 | 1 | 1 | 1 | 0 | 1 | 0 | 1 | 0 | 1 | 0 |
| 30 | 1 | 1 | 1 | 1 | 0 | 1 | 1 | 1 | 0 | 1 |
| 31 | 1 | 1 | 1 | 1 | 1 | 1 | 1 | 1 | 1 | 1 |

TABLE 9

Contents of the Delta-Demodulation Read-Only Memory 184A
The information below is identical to that contained in Table 4 (see referenced parent application), but written in binary form. Note also that negative values of $f(\Delta_i, \Delta_{i-1})$ are expressed in two's complement form.

| $\Delta_i$ | | $\Delta_{i-1}$ | | $f(\Delta_i, \Delta_{i-1})$ | | | |
|---|---|---|---|---|---|---|---|
| LSB $A_0'$ | MSB $A_1'$ | LSB $A_2'$ | MSB $A_3'$ | MSB $B_0'$ | $B_1'$ | $B_2'$ | LSB $B_3'$ |
| 0 | 0 | 0 | 0 | 1 | 1 | 0 | 1 |
| 0 | 0 | 0 | 1 | 1 | 1 | 1 | 1 |
| 0 | 0 | 1 | 0 | 1 | 1 | 0 | 1 |
| 0 | 0 | 1 | 1 | 1 | 1 | 1 | 1 |
| 0 | 1 | 0 | 0 | 0 | 0 | 0 | 0 |
| 0 | 1 | 0 | 1 | 0 | 0 | 0 | 1 |
| 0 | 1 | 1 | 0 | 0 | 0 | 0 | 0 |
| 0 | 1 | 1 | 1 | 0 | 0 | 0 | 1 |
| 1 | 0 | 0 | 0 | 1 | 1 | 1 | 1 |
| 1 | 0 | 0 | 1 | 0 | 0 | 0 | 0 |
| 1 | 0 | 1 | 0 | 1 | 1 | 1 | 1 |
| 1 | 0 | 1 | 1 | 0 | 0 | 0 | 0 |
| 1 | 1 | 0 | 0 | 0 | 0 | 0 | 1 |
| 1 | 1 | 0 | 1 | 0 | 0 | 1 | 1 |
| 1 | 1 | 1 | 0 | 0 | 0 | 0 | 1 |
| 1 | 1 | 1 | 1 | 0 | 0 | 1 | 1 |

For simplicity, the previous hardware description of the preferred embodiment has not included handling of the symmetrized waveform produced by the compression scheme of phase adjusing. Instead, it was assumed that complete symmetrized waveforms (instead of only half of each such waveform) are stored in the phoneme memory 104. It is the purpose of the following discussion to incorporate the handling of symmetrized waveforms in the preferred embodiment.

This result may be achieved by storing the output waveform of the delta modulation decoder 184 of FIG. 10 in either a random access memory or left-right shift register for later playback into the digital to analog converter 186 during the second quarter of each period of each phase adjusted phoneme. The same result may also be achieved by running the delta modulation decoder circuit 184 backwards during the second quarter of such periods because the same information used to generate the waveform can be used to produce its symmetrized image. In the operation of the circuitry of the preferred embodiment in this manner, the control logic 172, the output shift register 176, and the delta modulation decoder 184, of FIG. 10 must be modified as is described below, for each half period zeroed phoneme (since half period zeroing and phase adjusting always occur together). Phonemes which are not half period zeroed do not utilize the compression scheme of phase adjusting. For such phonemes the operation of the circuitry of the preferred embodiment remains the same as described above.

When half period zeroing and phase adjusting are used, the 96 four-bit levels which generate one pitch period of sound are divided into three groups. The first 24 levels comprise the first group and are generated from 24 two-bit pieces of delta modulated information. This information is stored in the phoneme memory 104 as six consecutive 8-bit bytes which are presented to the output shift register 176 by the control logic 172 and are decoded by the delta modulation decoder 184 to form 24 four-bit levels. The operation of the circuitry of the preferred embodiment during the playing of these first 24 output levels is unchanged from that described above. The next 24 levels of the output comprise the second group and are the same as the first 24 levels, except that they are output in reverse order, i.e., level 25 is the same as level 24, level 26 is the same as level 23, and so forth to level 48, which is the same as level 1. To perform this operation, the previously described operation of the circuit of FIG. 10 is modified. First, the control logic 172 is changed so that during the second 24 levels of output, instead of taking the next six bytes of data from the phoneme memory, the same six bytes that were used to generate the first 24 levels are used, but they are taken in the reverse order. Second, the direction of shifting, and the point at which the output is taken from the output shift register 176 is changed such that the 24 pieces of two-bit delta modulation information are presented to the delta modulation decoder circuit 184 reversed in time from the way in which they were presented during the generation of the first 24 levels. Thus, the input of the delta modulation decoder 184 at which the previous value of delta modulation information was presented during the generation of the first 24 levels has, instead, input to it, the future value. Third, the delta modulation decoder 184 is changed so that the sign of the function $f(\Delta_{i-1},\Delta_i)$ described in Table 4 is changed. With these modifications, the delta demodulator circuit 184 will operate in reverse, i.e., for an input which is presented reversed in time, it will generate the expected output waveform, but reversed in time. This process can be illustrated by considering the example of Table 10, for the case where the changes to the output shift register 176, and the delta modulation decoder 184 described above have been made. Referring to Table 10, suppose that digitization 24 is the 24th output level for a phoneme in which half period zeroing and phase adjusting are used. Since the amplitude of the reconstructed waveform for this digitization is 9, the 25th output level will again have the value 9. Subsequent values of the output will be generated from the same series of 24 values of $\Delta_i$, but taken in reverse order, and with the modifications to the delta modulation algorithm indicated above. Thus for the 26th output level, Table 10 gives $\Delta_i=3$ and $\Delta_{i-1}=3$. Table 4 gives $f(\Delta_{i-1},\Delta_i)=3$ for this case. Since one of the modifications to the delta modulation decoder 184 is to change the sign of $f(\Delta_{i-1},\Delta_i)$ the 26th output level is $9-3=6$. For the 27th output level, Table 10 gives $\Delta_i=2$ and $\Delta_{i-1}=2$. Applying the appropriate value of $f(\Delta_{i-1},\Delta_i)$ from Table 4 shows the 27th output level to be $6-3=3$. This process can be continued to show that the second 24 output levels will be the same as the first 24 levels, but reversed in time.

TABLE 10

Example of a Quarter Period of Delta Modulation Information and the Reconstructed Waveform

| Digitization | Delta Modulation Information (decimal) | Amplitude of Reconstructed Waveform |
|---|---|---|
| 1 | 3 | 10 |
| 2 | 3 | 13 |
| 3 | 2 | 14 |
| 4 | 2 | 15 |
| 5 | 1 | 15 |
| 6 | 1 | 14 |
| 7 | 0 | 11 |
| 8 | 0 | 8 |
| 9 | 0 | 5 |
| 10 | 1 | 4 |
| 11 | 3 | 5 |
| 12 | 2 | 6 |
| 13 | 3 | 9 |
| 14 | 3 | 12 |
| 15 | 0 | 11 |
| 16 | 0 | 8 |
| 17 | 0 | 5 |
| 18 | 1 | 4 |
| 19 | 1 | 3 |
| 20 | 1 | 2 |
| 21 | 2 | 2 |
| 22 | 2 | 3 |
| 23 | 3 | 6 |
| 24 | 3 | 9 |

For the case in which half period zeroing and phase adjusting are used, the last 48 output levels of each pitch period are always set equal to a constant. The operation of the circuitry of the preferred embodiment which accomplishes this is the same as described previously.

The terms and expressions which have been employed here are used as terms of description and not of limitations, and there is no intention, in the use of such terms and expressions, of excluding equivalents of the features shown and described, or portions thereof, it being recognized that various modifications are possible within the scope of the invention claims.

I claim:

1. For use with a synthesizer of original information bearing time domain signals from compressed information time domain signals produced by predetermined different signal compression techniques, a memory device comprising:

means for storing said compressed time domain signals and instruction signals in the form of X period zeroed representations of said original time domain signals, wherein X is a fraction in the range from about one-fourth to about three-fourths, specifying the particular X period zeroing compression technique applied to said original information bearing time domain signals to produce corresponding portions of said compressed information time domain signals, said compressed information time domain signals comprising a plurality of samples resulting from said predetermined X period zeroing signal compression technique; and means for enabling said compressed information time domain signals and said instruction signals to be read out from said memory device to enable said compressed information time domain signals to be expanded using the X period zeroing technique specified by the corresponding instruction signals.

2. The combination of claim 1 wherein X is one-half.

3. For use with a synthesizer of original information bearing time domain signals from compressed information time domain signals produced by predetermined different signal compression techniques, a memory device comprising:

means for storing said compressed information time domain signals and instruction signals in the form of floating-zero, two-bit delta modulated representations of said original time domain signals specifying the particular delta modulation compression technique applied to said original information bearing time domain signals to produce corresponding portions of said compressed information time domain signals, said compressed information time domain signals comprising a plurality of samples resulting from said predetermined floating-zero, two-bit delta modulation signal compression technique; and means for enabling said compressed information time domain signals and said instruction signals to be read out from said memory device to enable said compressed information time domain signals to be expanded using the floating-zero, 2-bit delta modulation expansion technique specified by the corresponding instruction signals.

* * * * *